US009157313B2

(12) United States Patent
Madhavan et al.

(10) Patent No.: US 9,157,313 B2
(45) Date of Patent: Oct. 13, 2015

(54) SYSTEMS AND METHODS FOR DETECTING DRILLSTRING LOADS

(75) Inventors: Raghu Madhavan, Katy, TX (US); Mark Sherman, Penang (MY)

(73) Assignee: INTELLISERV, LLC, Houston, TX (US)

( * ) Notice: Subject to any disclaimer, the term of this patent is extended or adjusted under 35 U.S.C. 154(b) by 467 days.

(21) Appl. No.: 13/486,328

(22) Filed: Jun. 1, 2012

(65) Prior Publication Data

US 2013/0319768 A1 Dec. 5, 2013

(51) Int. Cl.
*E21B 47/00* (2012.01)
*E21B 17/02* (2006.01)

(52) U.S. Cl.
CPC ..... *E21B 47/0006* (2013.01); *E21B 17/028* (2013.01)

(58) Field of Classification Search
CPC . E21B 17/028; E21B 41/0085; E21B 47/122; E21B 47/14; E21B 47/16; E21B 47/123; E21B 41/00; E21B 47/12; E21B 17/003; E21B 43/103; E21B 47/0006; G01V 11/002; G01V 3/00; G01L 5/0061; F16L 15/08; F16L 25/01; Y10S 439/95
USPC ..... 166/242.6, 380; 340/854.4, 854.8; 439/577, 38, 950; 367/82; 175/171, 50; 73/152.48, 152.52, 152.59, 862.451, 73/862.454
See application file for complete search history.

(56) References Cited

U.S. PATENT DOCUMENTS 4,297,880 A 11/1981 Berger
4,606,415 A 8/1986 Gray, Jr. et al.
5,184,508 A 2/1993 Desbrandes
5,386,724 A 2/1995 Das et al.
5,469,736 A 11/1995 Moake
5,887,657 A 3/1999 Bussear et al.
5,934,371 A 8/1999 Bussear et al.
(Continued)

FOREIGN PATENT DOCUMENTS

EA 007962 B1 2/2007
GB 2407334 A 4/2005
(Continued)

OTHER PUBLICATIONS

PCT/US2013/043360 International Search Report and Written Opinion dated Jun. 24, 2014 (13 p.).
(Continued)

*Primary Examiner* — Yong-Suk (Philip) Ro
(74) *Attorney, Agent, or Firm* — Conley Rose, P.C.

(57) ABSTRACT

A drilling system comprises a drillstring including a dill bit, a bottomhole assembly coupled to the drill bit, and a plurality of interconnected tubular members coupled to the bottomhole assembly. A first tubular member includes a communication link having a first annular inductive coupler element disposed in an annular recess in a first end, a second annular inductive coupler element disposed in an annular recess in a second end, and a cable coupling the first annular inductive coupler element to the second annular inductive coupler element. In addition, the drilling system comprises a first signal level determination unit disposed in the drillstring and configured to determine a level of a first signal communicated from the second inductive coupler element. Further, the drilling system comprises an axial load determination unit configured to determine an axial load at the first signal level determination unit based on the level of the first signal.

28 Claims, 14 Drawing Sheets

(56) References Cited

U.S. PATENT DOCUMENTS

| | | | |
|---|---|---|---|
| 5,959,547 | A | 9/1999 | Tubel et al. |
| 6,233,524 | B1 | 5/2001 | Harrell et al. |
| 6,252,518 | B1 | 6/2001 | Laborde |
| 6,374,913 | B1 | 4/2002 | Robbins et al. |
| 6,415,231 | B1 | 7/2002 | Hebert |
| 6,415,877 | B1 | 7/2002 | Fincher et al. |
| 6,615,933 | B1 | 9/2003 | Eddison |
| 6,648,081 | B2 | 11/2003 | Fincher et al. |
| 6,648,082 | B2 | 11/2003 | Schultz et al. |
| 6,659,197 | B2 | 12/2003 | Cooper |
| 6,662,110 | B1 | 12/2003 | Bargach et al. |
| 6,670,880 | B1 | 12/2003 | Hall et al. |
| 6,684,949 | B1 | 2/2004 | Gabler et al. |
| 6,712,160 | B1 | 3/2004 | Schultz et al. |
| 6,717,501 | B2 | 4/2004 | Hall et al. |
| 6,722,450 | B2 | 4/2004 | Schultz |
| 6,725,162 | B2 | 4/2004 | Edwards et al. |
| 6,732,052 | B2 | 5/2004 | MacDonald |
| 6,821,147 | B1 | 11/2004 | Hall et al. |
| 6,830,467 | B2 | 12/2004 | Hall et al. |
| 6,844,498 | B2 | 1/2005 | Hall et al. |
| 6,854,532 | B2 | 2/2005 | Fincher et al. |
| 6,868,920 | B2 | 3/2005 | Holeit et al. |
| 6,888,473 | B1 | 5/2005 | Hall et al. |
| 6,986,282 | B2 | 1/2006 | Cigienec et al. |
| 7,044,237 | B2 | 5/2006 | Leuchtenberg |
| 7,062,959 | B2 | 6/2006 | Kurkjian et al. |
| 7,082,821 | B2 | 8/2006 | Chen et al. |
| 7,139,218 | B2 | 11/2006 | Hall et al. |
| 7,174,975 | B2 | 2/2007 | Krueger et al. |
| 7,201,221 | B2 | 4/2007 | Tubel et al. |
| 7,207,396 | B2 | 4/2007 | Hall et al. |
| 7,270,185 | B2 | 9/2007 | Fontana et al. |
| 7,284,903 | B2 | 10/2007 | Hartog |
| 7,311,142 | B2 | 12/2007 | Fisseier et al. |
| 2002/0193004 | A1 | 12/2002 | Boyle et al. |
| 2004/0039466 | A1 | 2/2004 | Lilly et al. |
| 2004/0104797 | A1 | 6/2004 | Hall et al. |
| 2004/0113808 | A1 | 6/2004 | Hall et al. |
| 2004/0145492 | A1 | 7/2004 | Hall et al. |
| 2004/0150532 | A1 | 8/2004 | Hall et al. |
| 2005/0001735 | A1 | 1/2005 | Hall et al. |
| 2005/0092488 | A1 | 5/2005 | Rodet et al. |
| 2005/0092499 | A1 | 5/2005 | Hall et al. |
| 2005/0109097 | A1 | 5/2005 | Bogath et al. |
| 2005/0161215 | A1 | 7/2005 | Hall et al. |
| 2005/0173128 | A1 | 8/2005 | Hall et al. |
| 2005/0194182 | A1 | 9/2005 | Rodney et al. |
| 2005/0194184 | A1 | 9/2005 | Gleitman |
| 2005/0200498 | A1 | 9/2005 | Gleitman |
| 2005/0284663 | A1 | 12/2005 | Hall et al. |
| 2006/0065402 | A9 | 3/2006 | Fontana et al. |
| 2006/0157282 | A1 | 7/2006 | Tilton et al. |
| 2007/0017671 | A1 | 1/2007 | Clark et al. |
| 2007/0029112 | A1 | 2/2007 | Li et al. |
| 2007/0030167 | A1 | 2/2007 | Li et al. |
| 2007/0045006 | A1 | 3/2007 | Krueger et al. |
| 2007/0188344 | A1 | 8/2007 | Hache et al. |
| 2007/0263488 | A1 | 11/2007 | Clark |
| 2007/0272033 | A9 | 11/2007 | Jones |
| 2008/0041576 | A1 | 2/2008 | Patel |
| 2008/0135291 | A1 | 6/2008 | Hall et al. |

FOREIGN PATENT DOCUMENTS

| | | | |
|---|---|---|---|
| WO | 02/06716 | A1 | 1/2002 |
| WO | 03089758 | A1 | 10/2003 |
| WO | 2007016687 | A1 | 2/2007 |

OTHER PUBLICATIONS

Sperry Drilling Services, "PWD (Pressure White Drilling) Sensor", Aug. 2007 (2 pages).

Petrobras Emerging Well Technologies; by Placido, Joao Carlos Ribeiro, et al., Drilling & Well Technology, Oil & Gas Review, 2007 OTC Edition (4 pages).

IADE/SPE 112636; High Speed Telemetry Drill Pipe Network Optimizes Drilling Dynamics and Wellbore Placement, Ali, T. H., et al., 200B (8 pages).

IADE/SPE 112702. The Utilization of the Massive Amount of Real Time Data Acquired in Wired Drillpipe Operations, Olberg, et al., (13 pages), 2008.

IADC/SPE 115206, Evolution of Innovative Test Methodology for Evaluation or Hardfacing Materials in both Cased and Open Environments; Chan, Alvaro, et al., SPE International, 2008 (15 pages).

IADC/SPE 112740 Evolution of Drilling Programs and Complex Well Profiles Drive Development of Fourth-Generation Hardband Technology, Chan, Alvaro, et al 2008 (17 pages).

Russian Patent Application No. 2010137427 Office Action dated Nov. 19, 2012.

SYSTEMS AND METHODS FOR DETECTING DRILLSTRING LOADS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The invention relates generally to systems and methods for sensing axial loads in a drillstring. More particularly, the invention relates to systems and methods for sensing weight-on-bit and axial loads in a drillstring that provide reduced sensitivity to differential temperature, differential pressure and bending effects on the drillstring.

2. Background of the Technology

The axial loads and torque applied to a drill bit during the drilling of a well are important parameters affecting the direction and inclination of the borehole, drilling efficiency, the durability of the drill bit, as well as the economics of the drilling operation. In addition, determination of the axial loads and torques acting on the drill bit allow an operator to detect the onset of drilling problems and correct undesirable situations before a failure of any part of the system. Some of the problems that can be detected by measuring the axial loads and torques on the drill bit include motor stall, stuck pipe, and bottom hole assembly ("BHA") tendency. By determining these forces, a drill operator is also able to optimize drilling conditions so a borehole can be drilled in the most economical way. Consequently, the axial loads and torques applied to a drill bit are carefully monitored and controlled during drilling operations.

The axial compressive load on the drill bit is often referred to as "weight-on-bit" or "WOB." Weight is typically applied to the drill bit by a string of heavy drill collars that are attached above the drill bit and suspended in the borehole on a smaller diameter drillstring. In conventional drilling practice, the entire length of the drillstring and the upper portion of the drill collar are suspended at the surface in tension by a derrick so that the amount of WOB can be adjusted by changing the surface hook load. WOB is carefully controlled during drilling operations as it affects the rate of penetration (ROP) of the drill bit, the drill bit wear and the direction of drilling. The torque applied to the drill bit ("torque-on-bit" or "TOB") is also important with regard to drill bit wear and drilling direction, particularly when considered together with measurements of WOB. Excessive TOB is indicative of serious bit damage such as bearing failure and locked cones.

Typically, measurements of WOB are made at the surface by comparing the "hook load weight" of the drillstring to the "off-bottom weight" of the drillstring, and measurements of TOB are made by measuring the torque applied to the drillstring at the surface. However, reliability of such surface measurements of WOB and TOB are a known problem as other forces acting on the drillstring downhole often interfere with surface measurement.

More recently, systems have been devised for taking measurements "downhole" and transmitting these measurements to the surface during the drilling of the borehole. Typically, such systems rely on one or more strain gauges coupled to the drillstring downhole proximal the drill bit. In general, a strain gauge is a small resistive device that is attached to a material whose deformation is to be measured. The strain gauge is attached in such a way that it deforms along with the material to which it is attached. The electrical resistance of the strain gauge changes as it is deformed. By applying an electrical current to the strain gauge and measuring the differential voltage across it, the resistance, and thus the deformation, of the strain gauge can be measured. However, such strain gauges are subject to significant inaccuracies because they may be deformed by means other than axial loads on the drillstring. For example, strain gauges may experience deformation due to bending of the drillstring, pressure differentials between the drilling mud within the drillstring and borehole pressure outside the drillstring, and temperature gradients. Unfortunately, strain gauges are not adept at distinguishing between strain due to axial loads versus axial strain induced by pressure differentials, temperature gradients, and bending.

Accordingly, there remains a need in the art for improved systems and methods for sensing axial loads on a drillstring and WOB. Such systems and methods would be particularly well-received if they were less susceptible to inaccuracies due to pressure differentials, temperature gradients, and bending of the drillstring.

BRIEF SUMMARY OF THE DISCLOSURE

These and other needs in the art are addressed in one embodiment by a drilling system for drilling a borehole in an earthen formation. In an embodiment, the drilling system comprises a drillstring having a longitudinal axis, a first end, and a second end opposite the first end. The drillstring includes a dill bit at the second end, a bottomhole assembly coupled to the drill bit, and a plurality of interconnected tubular members coupled to the bottomhole assembly. Each tubular member has a first end and a second end opposite the first end. A first tubular member includes a communication link having a first annular inductive coupler element disposed in an annular recess in the first end of the first tubular member, a second annular inductive coupler element disposed in an annular recess in the second end of the first tubular member, and a cable coupling the first annular inductive coupler element to the second annular inductive coupler element. In addition, the drilling system comprises a first signal level determination unit disposed in the drillstring. The signal level determination unit is configured to determine a level of a first signal communicated from the second inductive coupler element. Further, the drilling system comprises an axial load determination unit configured to determine an axial load at the first signal level determination unit based on the level of the first signal.

These and other needs in the art are addressed in another embodiment by a method for determining axial loads in a drillstring. In an embodiment, the method comprises (a) drilling with a drilling system including a drillstring comprising a drill bit, a bottomhole assembly coupled to the drill bit, and a plurality of WDP joints coupled to the bottomhole assembly. In addition, the method comprises (b) measuring a level of a first signal communicated from a first inductive coupler element in the drillstring during (a). Further, the method comprises (c) determining an axial load in a first region of the drillstring using the level of the first signal.

These and other needs in the art are addressed in another embodiment by a drilling system for drilling a borehole in an earthen formation. In an embodiment, the drilling system comprises a drillstring having a longitudinal axis, a first end, and a second end opposite the first end. The drillstring includes a dill bit at the second end, a bottomhole assembly coupled to the drill bit, and a plurality of interconnected tubular members coupled to the bottomhole assembly. Each tubular member has a first end and a second end opposite the first end. A first tubular member includes a communication link having a first annular inductive coupler element disposed in an annular recess in the first end of the first tubular member, and a second annular inductive coupler element disposed in an annular recess in the second end of the first tubular member and electrically coupled to the first inductive coupler element. In addition, the drilling system comprises a first impedance measurement unit disposed in the drillstring. The first impedance measurement unit is configured to determine an impedance of the second inductive coupler element.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
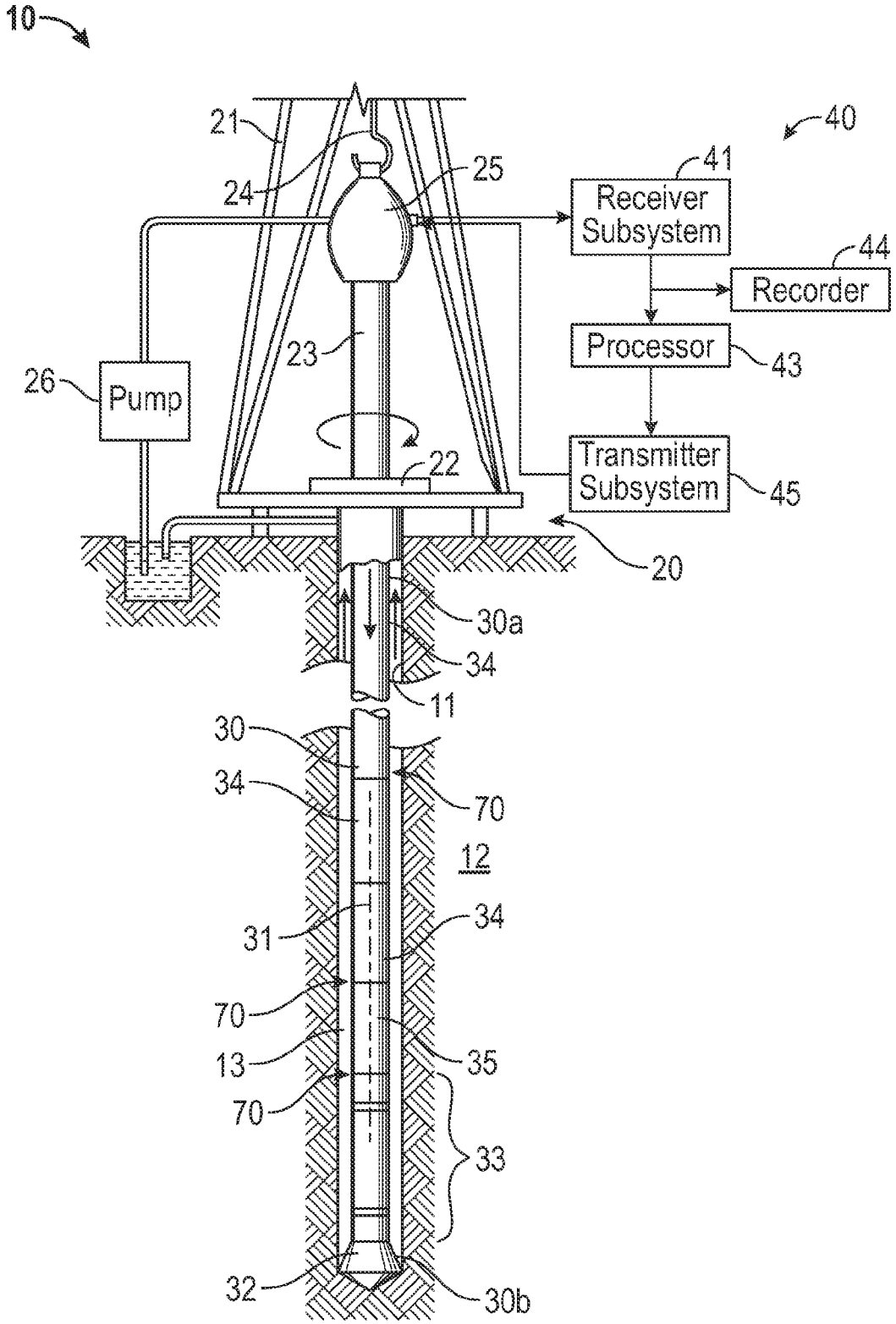
FIG. 1 is a schematic view of an embodiment of a drilling system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Still further, as used herein, the phrase "communication coupler" refers to a device or structure that communicates a signal across the respective ends of two adjacent tubular members, such as the threaded box/pin ends of adjacent pipe joints; and the phrase "wired drill pipe" or "WDP" refers to one or more tubular members, including drill pipe, drill collars, casing, tubing, subs, and other conduits, that are configured for use in a drill string and include a wired link. As used herein, the phrase "wired link" refers to a pathway that is at least partially wired along or through a WDP joint for conducting signals, and "communication link" refers to a plurality of communicatively-connected tubular members, such as interconnected WDP joints for conducting signals over a distance.

Referring now to FIG. 1, an embodiment of a drilling system 10 is schematically shown. In this embodiment, drilling system 10 includes a drilling rig 20 positioned over a borehole 11 penetrating a subsurface formation 12 and a drillstring 30 suspended in borehole 11 from a derrick 21 of rig 20. Elongate drillstring 30 has a central or longitudinal axis 31, a first or upper end 30*a*, and a second or lower end 30*b* opposite end 30*a*. In addition, drillstring 30 includes a drill bit 32 at lower end 30*b*, a bottomhole assembly (BHA) 33 axially adjacent bit 32, and a plurality of interconnected wired drill pipe (WDP) joints 34 between BHA 33 and upper end 30*a*. To aid in the transmission of data along drillstring 30 through WDP joints 34, one or more repeaters can be placed at selected intervals along drillstring 30 to act as relay points, amplifiers, points of data acquisition, or the like. BHA 33, WDP joints 34, axial load analysis sub 35, and any repeaters in drillstring 30 are coupled together end-to-end with tool joints 70. As will be described in more detail below, axial load analysis sub 35 is configured to determine the axial loads in drillstring 30 and associated WOB, and transmit such data to the surface. In this embodiment, an axial load analysis sub 35 is positioned along drillstring 30 axially adjacent BHA 33.

However, in general, axial load analysis sub 35 may be disposed at any other locations along drillstring 30.

In general, BHA 33 can include drill collars, drilling stabilizers, a mud motor, directional drilling equipment, a power generation turbine, as well as capabilities for measuring, processing, and storing information, and communicating with the surface (e.g., MWD/LWD tools, telemetry hardware, etc.). Examples of communication systems that may be included in BHA 33 are described in U.S. Pat. No. 5,339,037, which is hereby incorporated herein by reference in its entirety.

In this embodiment, drill bit 32 is rotated by rotation of drillstring 30 at the surface. In particular, drillstring 30 is rotated by a rotary table 22, which engages a kelly 23 coupled to upper end 30*a*. Kelly 23, and hence drillstring 30, is suspended from a hook 24 attached to a traveling block (not shown) with a rotary swivel 25 which permits rotation of drillstring 30 relative to hook 24. Although drill bit 32 is rotated from the surface with drillstring 30 in this embodiment, in general, the drill bit (e.g., drill bit 32) can be rotated via a rotary table and/or a top drive, rotated by downhole mud motor disposed in the BHA (e.g., BHA 33), or combinations thereof (e.g., rotated by both rotary table via the drillstring and the mud motor, rotated by a top drive and the mud motor, etc.). For example, rotation via a downhole motor may be employed to supplement the rotational power of a rotary table, if required, and/or to effect changes in the drilling process. Thus, it should be appreciated that the various aspects disclosed herein are adapted for employment in each of these drilling configurations and are not limited to conventional rotary drilling operations. In either case, the rate-of-penetration (ROP) of the drill bit 32 into the formation 12 largely depends upon the weight-on-bit and the drill bit rotational speed.

During drilling operations, a mud pump 26 at the surface pumps drilling fluid or mud down the interior of drillstring 30 via a port in swivel 25. The drilling fluid exits drillstring 30 through ports or nozzles in the face of drill bit 32, and then circulates upwardly to the surface through the annulus 13 between drillstring 30 and the wall of borehole 11. In this manner, the drilling fluid lubricates and cools drill bit 32, and carries formation cuttings to the surface.

A transmitter in BHA 33 transmits communication signals through WDP joints 34, load analysis sub 35, and any repeaters in drillstring 30 to a data analysis and communication system 40 at the surface. As will be described in more detail below, each tubular in drillstring 30 (i.e., WDP joints 34, sub 35, repeaters, etc.) includes a wired communication link that allows transmission of communication signals along the tubular, and each tool joint 70 includes an inductive communication coupler that allows transmission of communication signals across the tool joint 70, thereby enabling transmission of communication signals (e.g., telemetry signals) between BHA 33 or other component in drillstring 30 (e.g., load analysis sub 35) and system 40.

In this embodiment, system 40 includes a receiver 41 that receives communication signals from drillstring 30, a processor 43 for decoding data communicated in the signal drillstring 30 and processing the decoded data, and a recorder 44. Surface system 40 also includes a transmitter 45 for communicating with BHA 33 and other downhole instruments (e.g., load analysis sub 35) through drillstring 30. Thus, in this embodiment, drillstring 30 defines a telemetry system wherein a plurality of WDP joints 34, load analysis sub 35, and repeaters are interconnected to form a communication link between BHA 33 and surface system 40.

Figure 2:
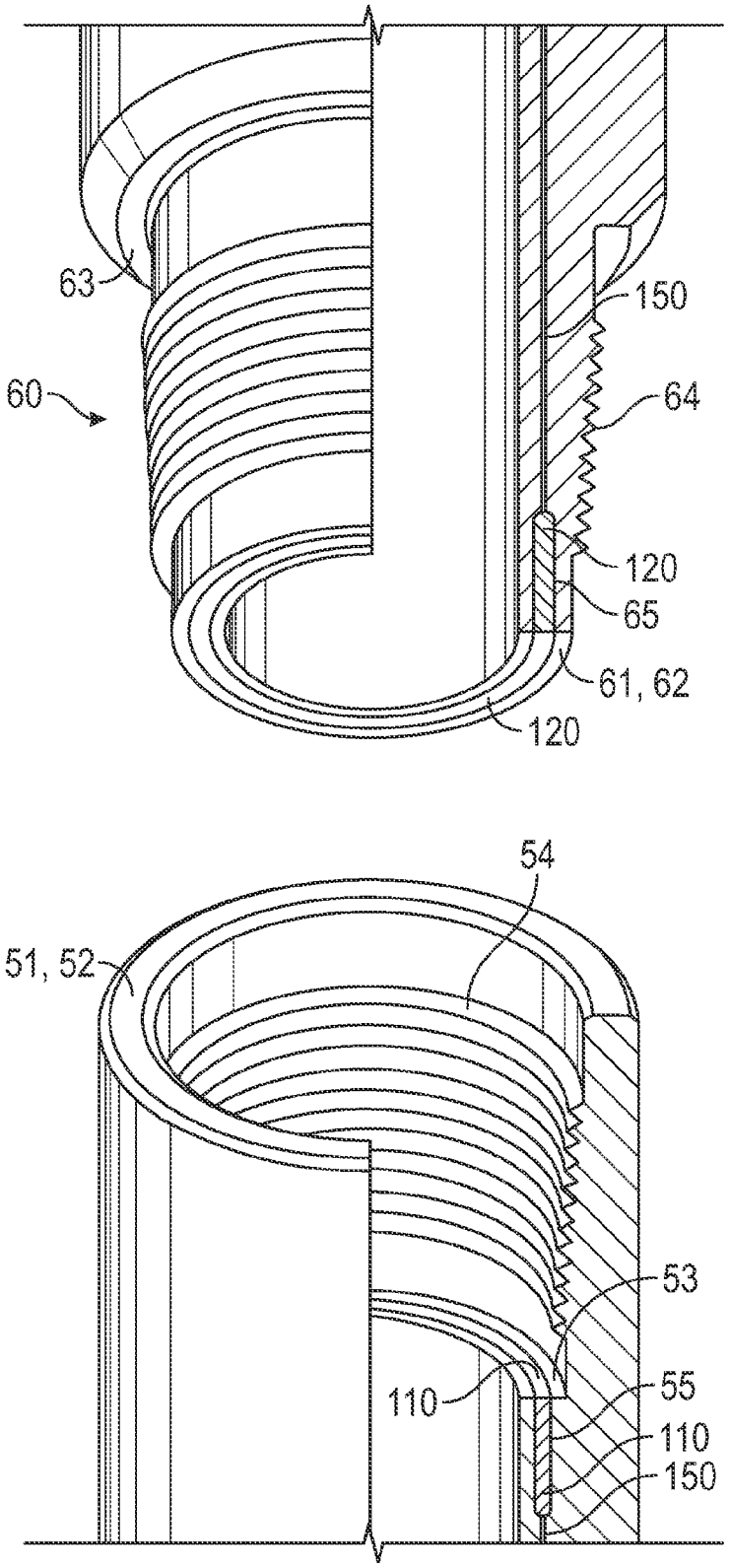
FIG. 2 is a perspective partial cross-sectional view of a pin end and a mating box end of two tubulars forming the drillstring of FIG. 1.
Figure 3:
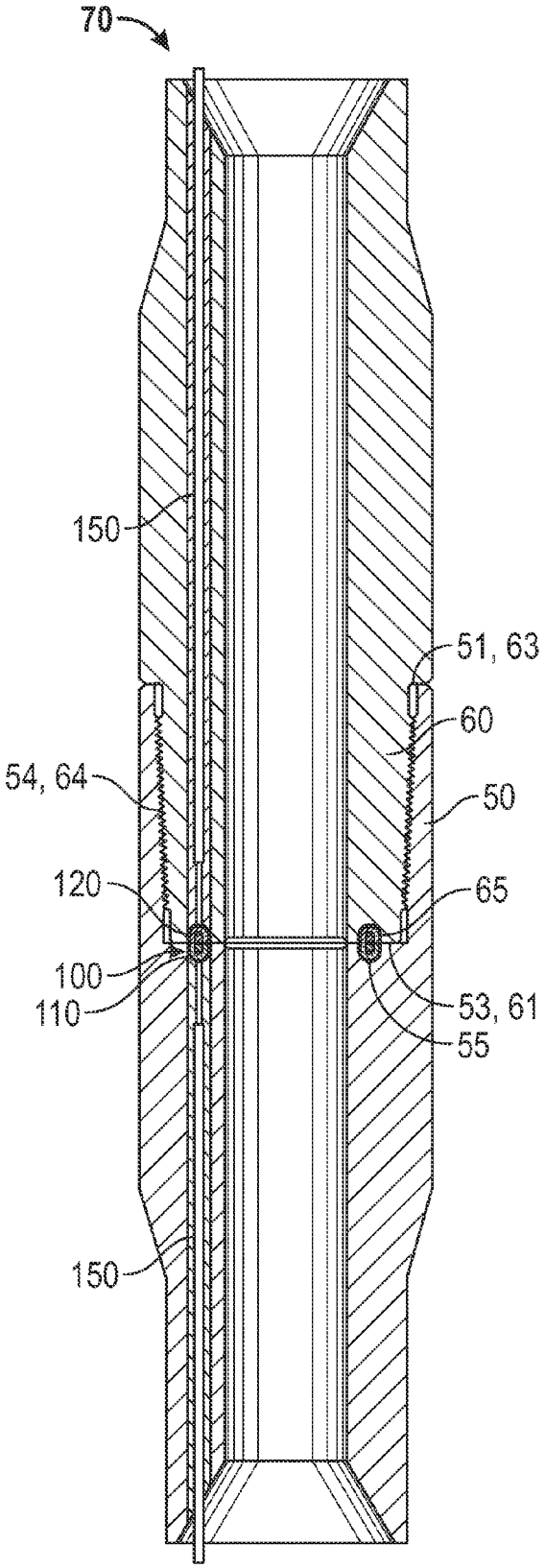
FIG. 3 is a cross-sectional view of a tool joint formed with the pin end and the box end of FIG. 2.

Referring now to FIGS. 2 and 3, the tubulars forming drillstring 30 (e.g., WDP joints 34, load analysis sub 35, repeaters, etc.) include an axial bore that allows the flow of drilling fluid through string 30, a box end 50 at one end (e.g., the lower end), and a pin end 60 at the opposite end (e.g., the upper end). Box ends 50 and pin ends 60 physically interconnect the tubulars end-to-end, thereby defining tool joints 70. For example, each WDP joint 34 includes a box end 50 at one axial end of the joint 34 and a pin end 60 at the other axial end of the joint 34, and likewise, load analysis sub 35 includes a box end 50 at one axial end of sub 35 and a pin end 60 at the other axial end of the sub 35.

FIGS. 2 and 3 illustrates one box end 50 and one mating pin end 60 for forming one tool joint 70, it being understood that all the pin ends, box ends, and tool joints in drillstring 30 are configured similarly. Box end 50 includes a radially outer annular shoulder 51 defining an end face 52 of box end 50, a radially inner annular shoulder 53 axially spaced from shoulder 51, and internal threads 54 axially positioned between shoulders 51, 53. Pin end 60 includes an radially inner annular shoulder 61 defining an end face 62 of pin end 60, a radially outer annular shoulder 63 axially spaced from shoulder 61, and external threads 64 axially positioned between shoulders 61, 63. Since box end 50 and pin end 60 each include two planar shoulders 51, 53 and 61, 63, respectively, ends 50, 60 may be referred to as "double shouldered."

As best shown in FIG. 3, box end 50 is threaded into pin end 60 via mating threads 54, 64 to form tool joint 70. When threading box end 50 into a pin end 60, outer shoulders 51, 63 may axially abut and engage one another, and inner shoulders 53, 61 may axially abut and engage one another to provide structural support to the connection. Since outer shoulders 51, 63 provide the majority of structural support and strength to the connection, they are often referred to as "primary shoulders" and inner shoulders 53, 61 are often referred to as "secondary shoulders."

Referring still to FIG. 3, an inductive communication coupler 100 is used to communicate signals and data across each tool joint 70 (i.e., communicated between mating box end 50 and pin end 60) in drillstring 30. Although only one communication coupler 100 is shown in FIG. 3, each communication coupler 100 in drillstring 30 is configured similarly. Communication coupler 100 includes a first annular inductive coupler element 110 and a second annular inductive coupler element 120 axially opposed first inductive coupler element 110. In this embodiment, first inductive coupler element 110 is seated in an annular recess 55 formed in inner shoulder 53 of box end 50 and second inductive coupler element 120 is seated in an annular recess 65 formed in inner shoulder 61 of pin end 60. Since shoulders 53, 61 may contact or come very close to one another, coupler elements 110, 120 may sit substantially flush with corresponding shoulders 53, 61. Thus, in this embodiment, coupling elements 110, 120 are disposed in opposed recesses 55, 65, respectively, in inner shoulders 53, 61, respectively. However, in other embodiments, the inductive coupling elements (e.g., elements 110, 120) may be seated in opposed recesses formed in the outer shoulders (e.g., shoulders 51, 63), or a first pair of inductive coupling elements can be seated in opposed recesses formed in the outer shoulders and a second pair of inductive coupling elements can be seated in opposed recesses formed in the inner shoulders.

Figure 4:
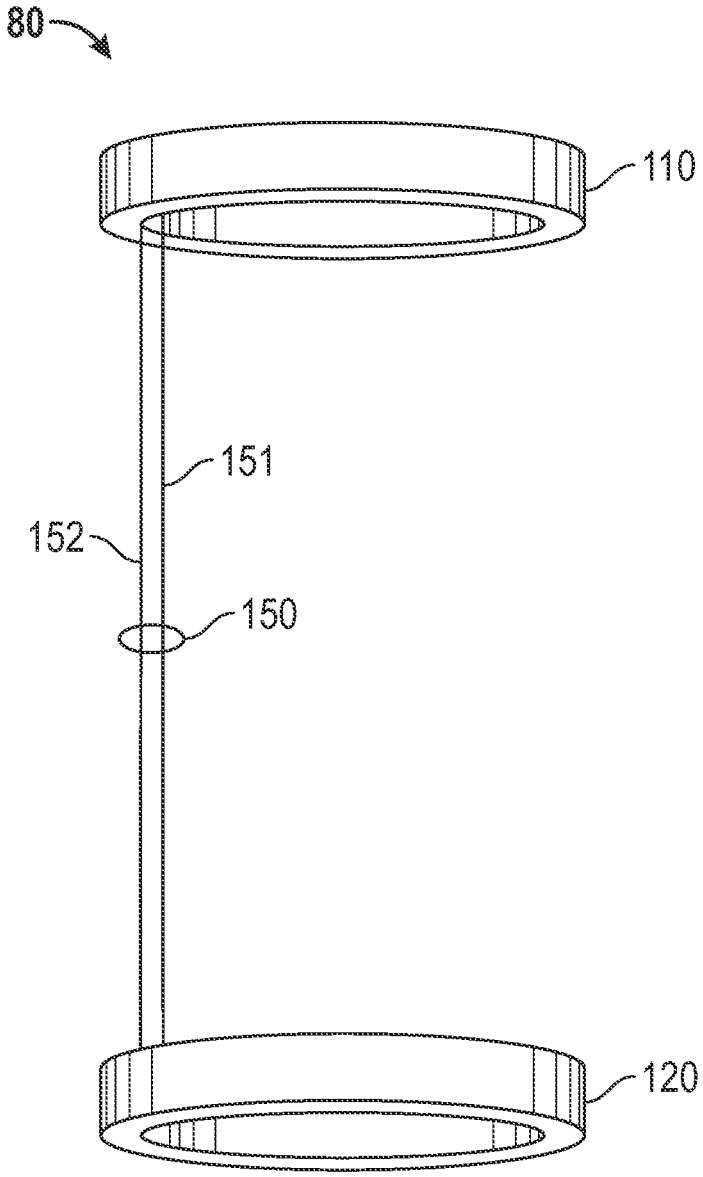
FIG. 4 is a schematic view of a wired link in one tubular in the drillstring of FIG. 1.

Referring now to FIGS. 3 and 4, as previously described, each tubular in drillstring 30 (e.g., WDP joints 34, load analysis sub 35, repeaters, etc.) includes a box end 50 at one end and a pin end 60 at the opposite end. Further, each box end 50 includes a first annular coupler element 110 and each pin end 60 includes a second annular coupler element 120. Coupler elements 110, 120 disposed in the box end 50 and pin end 60, respectively, of each tubular are interconnected by a cable 150 including a pair of insulated conducting wires 151, 152 routed within the tubular body from the box end 50 to the pin end 60. Cable 150 transmits signals and data between coupler elements 110, 120 of the tubular. Together, inductive coupler element 110, inductive coupler element 120 and cable 150 within each tubular in drillstring 30 define a wired link 80 within the tubular. Wired links 80 in the tubulars of drillstring 30 define the communication link between BHA 33 and surface system 40. Communication signals (e.g., telemetry communication signals) can be transmitted through the communication link from BHA 33 or other component in drillstring 30 (e.g., load analysis sub 35) to surface system 40, or from surface system 40 to BHA 33 or other component in drillstring 30 (e.g., load analysis sub 35).

Figure 5:
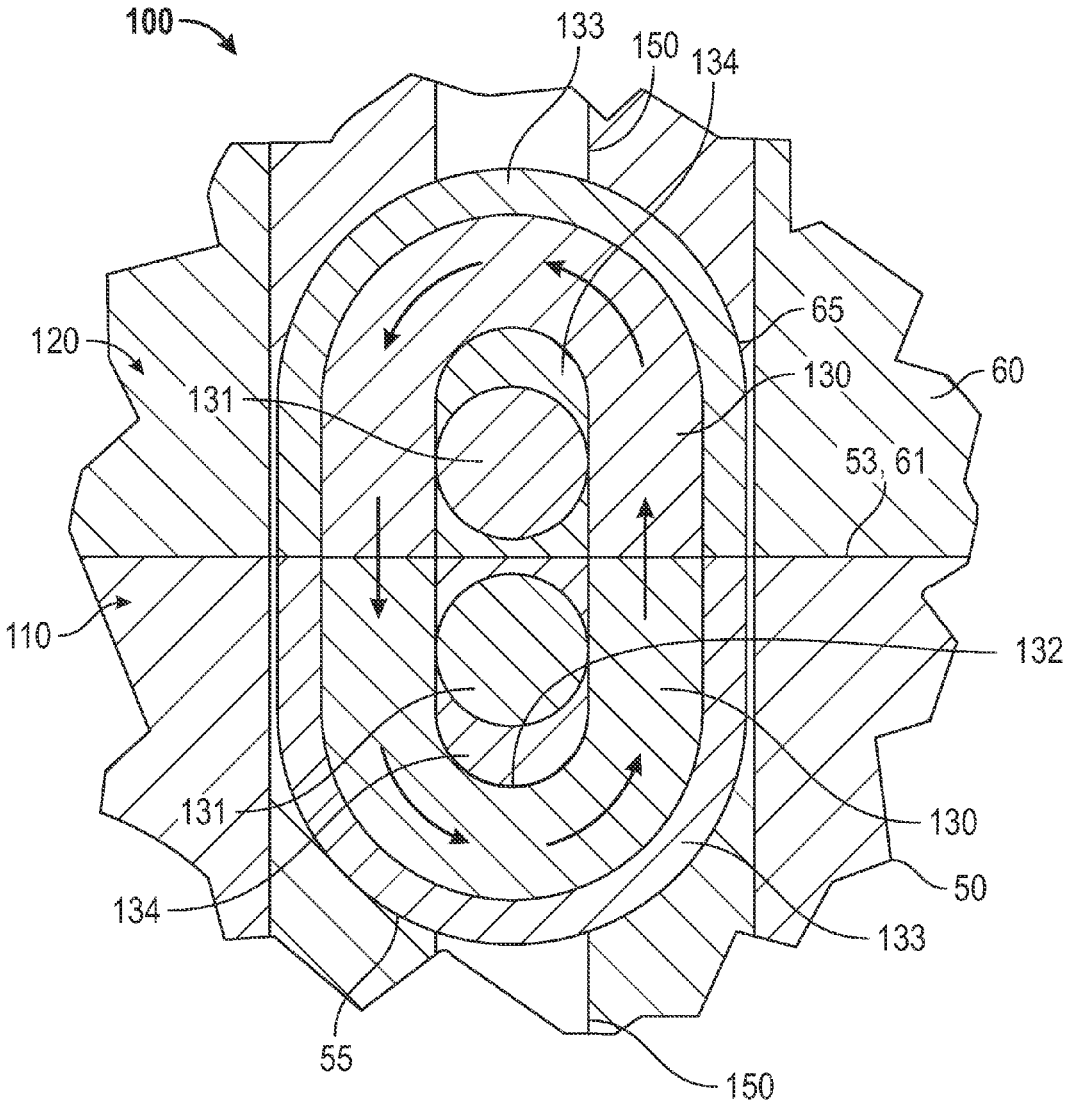
FIG. 5 is an enlarged cross-sectional view of an embodiment of an inductive communication coupler.

Referring now to FIG. 5, first coupler element 110 and second coupler element 120 may be configured as inductive coils as described in U.S. Pat. No. 6,717,501, which is hereby incorporated herein by reference in its entirety. In such embodiments, each coupler element 110, 120 includes an annular magnetically conducting, electrically insulating (MCEI) element 130 disposed within recess 55, 65, respectively, and an electrically conductive coil 131 disposed within an annular U-shaped trough 132 in MCEI element 130.

MCEI elements 130 are preferably made from a single material that is magnetically conductive and electrically insulating. In addition, MCEI elements 130 are preferably made from a material having a magnetic permeability sufficiently high to keep the field out of the surrounding steel and yet sufficiently low to minimize losses due to magnetic hysteresis. In particular, the magnetic permeability of MCEI elements 130 is preferably greater than that of steel, which is typically about 40 times that of air, and less than about 2,000 times that of air. An example of a suitable material for MCEI element 130 is ferrite commercially available from Fair-Rite Products Corp., Wallkill, N.Y., grade 61, having a magnetic permeability of about 125 times that of air. The MCEI element 130 may be formed from a single piece of MCEI material, or formed from several circumferentially adjacent segments of MCEI material which are held together in the appropriate configuration by means of a resilient material, such as an epoxy, a natural rubber, a fiberglass or carbon fiber composite, or a polyurethane.

In this embodiment, a resilient material 133, such as a polyurethane, is disposed between each MCEI element 130 and the steel surface of the corresponding recess 55, 65. Resilient material 133 holds the MCEI elements 130 in place and forms a transition layer between MCEI elements 130 and the steel which protects elements 130 from some of the forces seen by the steel during joint makeup and drilling.

Each electrically conductive coil 131 is disposed in a corresponding trough 132 and comprises at least one loop of insulated wire coupled to wires 151, 152 of the corresponding cable 150. The wire of each coil 131 is preferably made of copper and insulated with varnish, enamel, or a polymer. The geometry of the wire and the number of loops may be varied to adjust the impedance of each conductive coil 131 and desired operating frequency. Without being limited by this or any particular theory, increasing the number of turns decreases the operating frequency and increases the impedance; and lengthening the magnetic path, or making it narrower, also decreases the operating frequency and increases the impedance. In this embodiment, each coil 131 is embedded within an electrically insulating material 134, which fills the space within the trough 132 of MCEI element 130. Material 134 is preferably resilient to add further toughness to each MCEI element 130.

During drilling operations, the telemetry transmitter within BHA 33 encodes data on a high frequency alternating carrier signal that is transmitted to surface communication system 40 via cables 150 and communication couplers 100. At each communication coupler 100, the alternating current within coil 131 of first inductive coupler element 110 induces an alternating magnetic field within MCEI element 130 of first inductive coupler element 110. That magnetic field is conducted across joint 70 and into MCEI element 130 of second inductive coupler element 120. In particular, the two generally U-shaped MCEI elements 130 in coupler elements 110, 120 form a closed loop path for the magnetic flux, which circulates as shown by the arrows. The arrows reverse direction every time the current in coils 131 reverse direction. The magnetic field in MCEI element 130 in second inductive coupler element 120 induces an electric current in coil 131 of second inductive coupler element 120. The electric current induced in coil 131 of second inductive coupler element 120 travels along cable 150 to coil 131 located in MCEI element 130 at box end 50 of the tubular, and so on.

Figure 6:
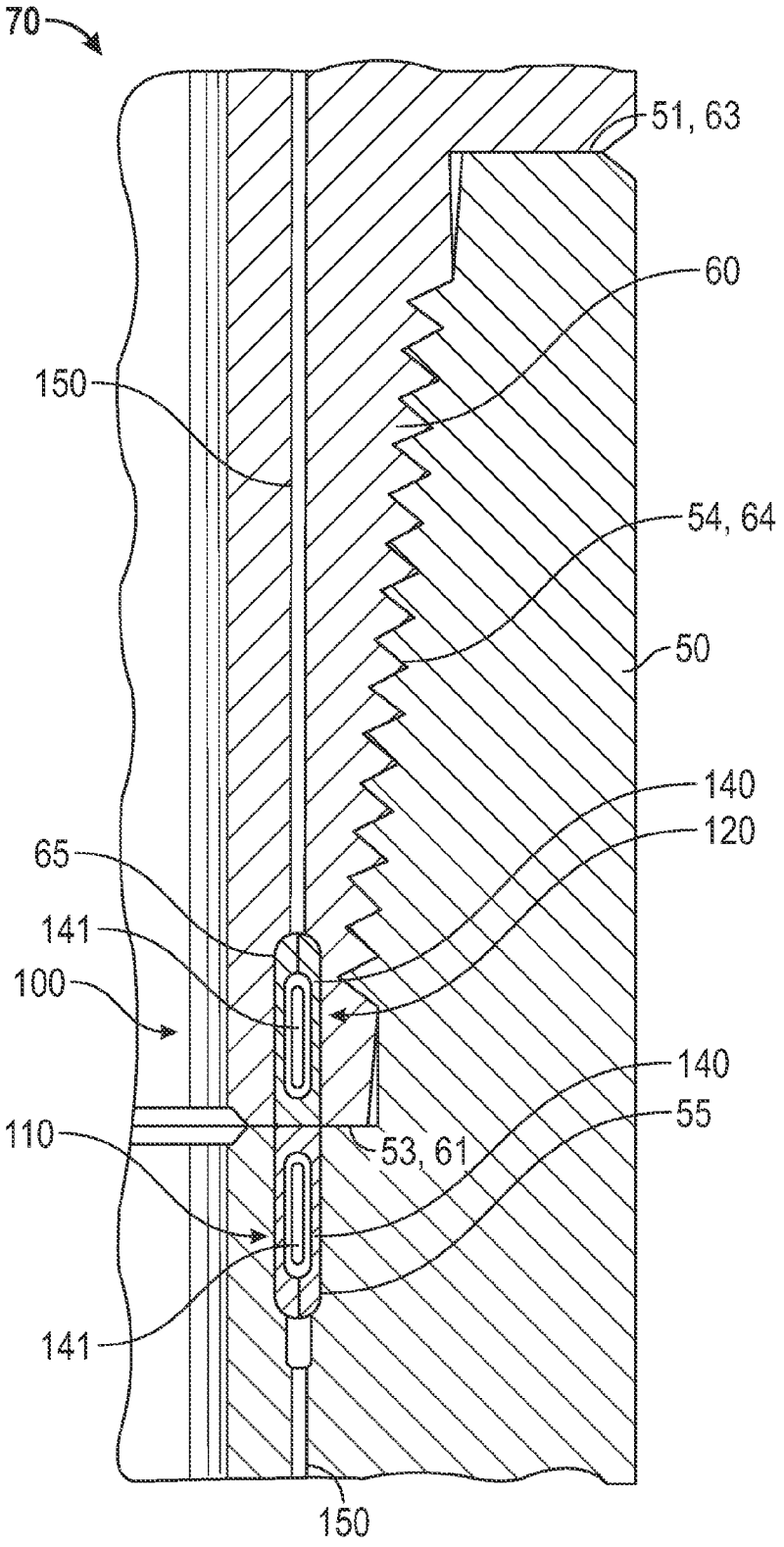
FIG. 6 is an enlarged cross-sectional view of an embodiment of an inductive communication coupler.
Figure 7:
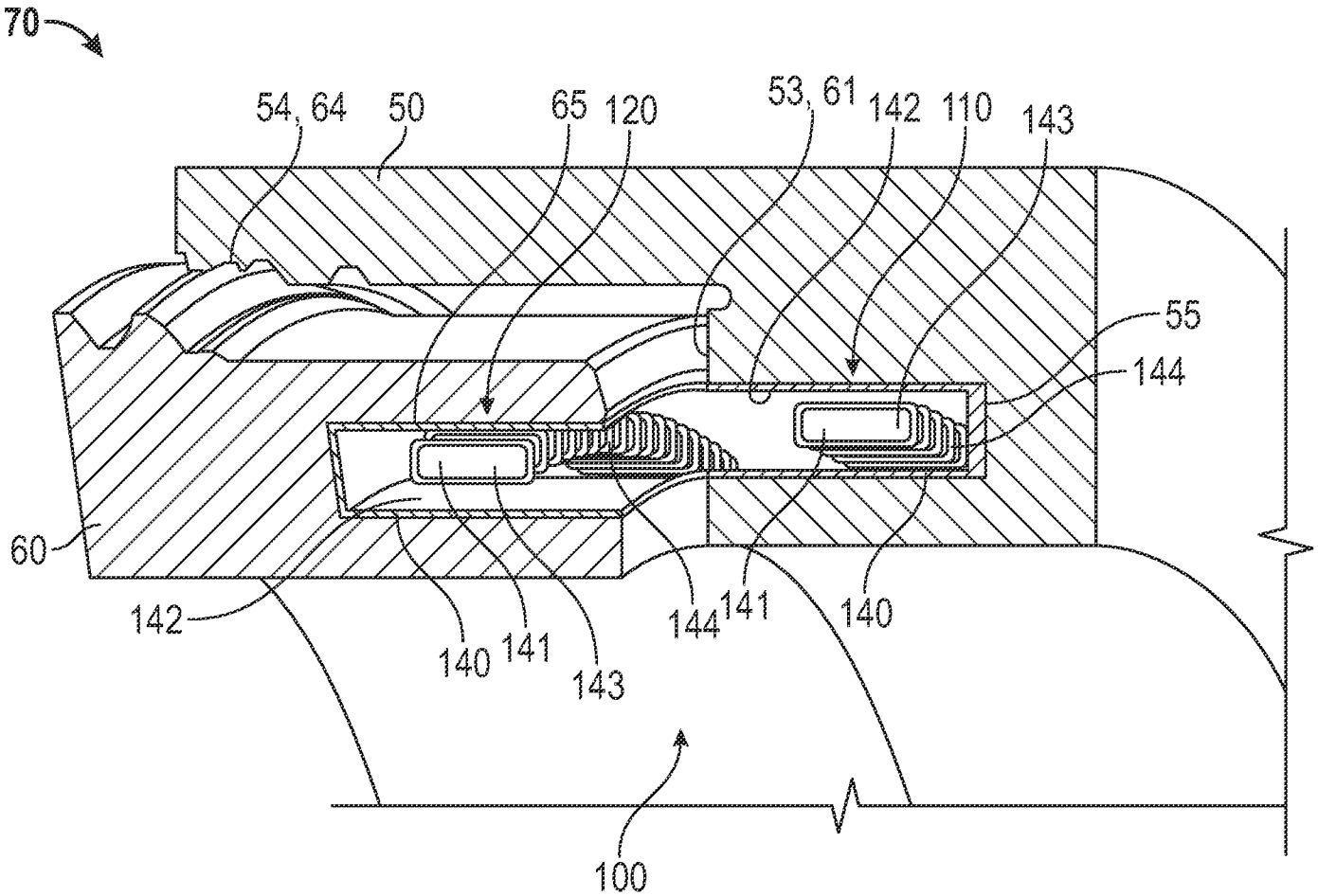
FIG. 7 is an enlarged partial cross-sectional perspective view of the inductive communication coupler of FIG. 6.

Referring now to FIGS. 6 and 7, in other embodiments, first inductive coupler element 110 and second inductive coupler element 120 may be configured as communicative couplers as described in U.S. Pat. No. 7,777,644, which is hereby incorporated herein by reference in its entirety. In such embodiments, each inductive coupler element 110, 120 includes an annular high-conductivity, low permeability (HCLP) element 140 disposed within recess 55, 65, respectively, and an annular inductive toroid 141 disposed within an annular U-shaped trough 142 in HCLP element 140.

HCLP element 140 is a high-conductivity, low-permeability material such as copper that enhances the efficiency of the inductive coupling between coupler elements 110, 120. In this embodiment, HCLP element 140 is copper cladding in recesses 55, 65.

As best shown in FIG. 7, each inductive toroid 141 includes an annular core 143 wrapped with N turns (~100 to 200 turn) of insulated wire 144 coupled to wires 151, 152. Annular core 143 is made of a high permeability, low loss material such as Supermalloy, which is a nickel-iron alloy processed for exceptionally high initial permeability and suitable for low level signal transformer applications. Insulated wire 144 is uniformly coiled around the circumference of core 143 to form the transformer coils. The inductive toroid 141 may be potted in rubber or other insulating material within HCLP element 140.

The above-described inductive couplers 110, 120 including inductive toroids 141 form a dual-toroidal coupler that utilizes inner shoulders 53, 61 as electrical contacts. In particular, inner shoulders 53, 61 are brought into engagement under extreme pressure as box end 50 and pin end 60 are made up, assuring electrical continuity therebetween.

During drilling operations, the telemetry transmitter within BHA 33 encodes data on a high frequency alternating carrier signal that is transmitted to surface communication system 40 via cables 150 and communication couplers 100. At each communication coupler 100, the alternating current in insulated wire 144 of first inductive coupler element 110 generates a magnetic field in core 143 of first inductive coupler element 110, which in turn, induces an alternating current in HCLP element 140 of first inductive coupler element 110. The alternating current in HCLP element 140 is conducted across joint 70 to HCLP element 140 of second inductive coupler element 120. In particular, the two generally U-shaped HCLP elements 140 in coupler elements 110, 120 form a closed loop path for the alternating current, which reverses direction every time the current in wire 144 reverse direction. The current in HCLP element 140 in second inductive coupler element 120 induces a magnetic field in core 143 of second inductive coupler element 120, which in turn, induces an electric current in insulated wire 144 of second inductive coupler element 120. The electric current induced in insulated wire 144 of second inductive coupler element 120 travels along cable 150 to insulated wire 144 disposed about HCLP element 140 at box end 50 of the tubular, and so on.

Figure 8:
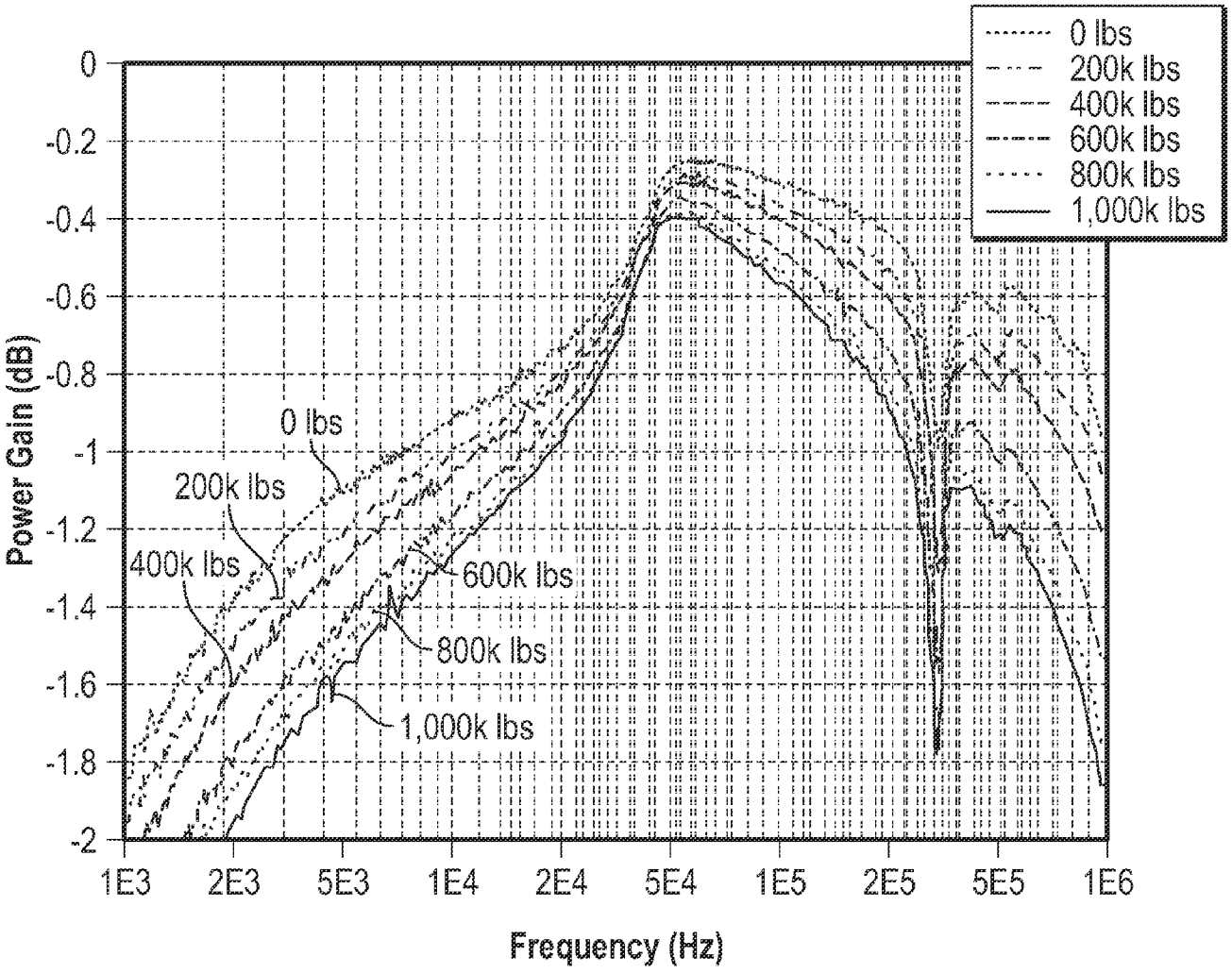
FIG. 8 is a graphical illustration of the gain of a signal across the inductive communication coupler of FIG. 6 as a function of axial tensile load over a range of signal frequencies.
Figure 9:
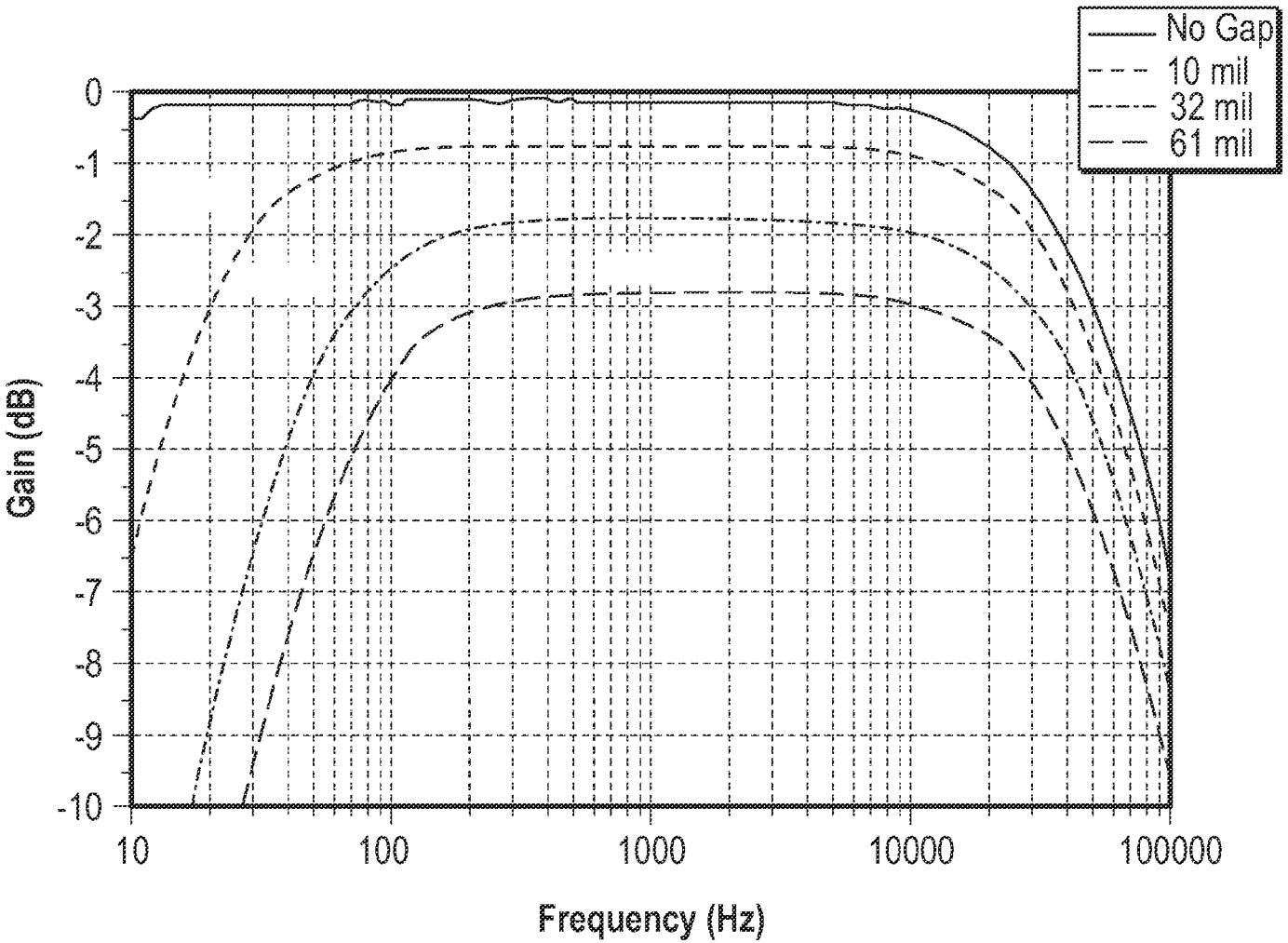
FIG. 9 is a graphical illustration of gain of a signal across the inductive communication coupler of FIG. 5 as a function of axial gap distance over a range of signal frequencies.

Referring now to FIGS. 8 and 9, for a given communication signal frequency, the level of the signal communicated across an inductive communication coupler 100 (e.g., voltage amplitude, current amplitude, power amplitude, power or voltage gain, transmission efficiency) varies as a function of axial loading of the corresponding tool joint 70. As will be described in more detail below, in embodiments described herein, this phenomena is leveraged to measure axial loads in drillstring 30 and WOB.

Referring now to FIG. 8, the measured signal level (expressed in terms of power gain) across exemplary inductive coupler elements 110, 120 of FIGS. 6 and 7 is shown at different axial tensile loads on tool joint 70 over a range of signal frequencies. For a given communication signal frequency, the signal db gain across tool joint 70 generally decreases as the axial tensile load on tool joint 70 increases. For instance, for an AC communication signal having a frequency of 2,000 Hz, with a 0 lbs axial tensile load on the tool joint 70, the measured gain across the inductive communication coupler is about −1.4 dB; with a 200 k lbs axial tensile load on the tool joint 70, the measured gain across the inductive communication coupler is about −1.62 dB; with a 400 k lbs axial tensile load on the tool joint 70, the measured gain across the inductive communication coupler is about −1.68 dB; with a 600 k lbs axial tensile load on the tool joint 70, the measured gain across the inductive communication coupler is about −1.84 dB; and with a 800 k lbs axial tensile load on the tool joint 70, the measured gain across the inductive communication coupler is about −1.93 dB; and with a 1,000 k lbs axial tensile load on the tool joint 70, the measured gain across the inductive communication coupler is about −2.0 dB. As shown in FIG. 8, the signal gain across tool joint 70 is inversely related to the axial tensile load on tool joint 70 (i.e., as the axial tensile load on tool joint 70 decreases, the signal gain across tool joint 70 increases). A decrease in the axial tensile load on tool joint 70 inherently results in an increase in the axial compressive load on tool joint 70. Thus, FIG. 8 also shows that as the axial compressive load on tool joint 70 increases (i.e., the axial tensile load on tool joint 70 decreases), the signal gain across tool joint 70 increases. In other words, the signal gain across tool joint 70 is directly related to the axial compressive load on tool joint 70.

Referring now to FIG. 9, the measured signal level (expressed in terms of power gain) across exemplary inductive coupler elements 110, 120 of FIG. 5 is shown at different gap distances measured axially between shoulders 53, 61 over a range of signal frequencies. It is to be understood that the axial gap distance between shoulders 53, 61 is inversely related to the axial compressive load on joint 70. Thus, as the axial compressive loads on joint 70 increase, the axial gap distance between shoulders 53, 61 decreases. For a given communication signal frequency, the signal db gain across tool joint 70 generally decreases as the axial gap distance between shoulders 53, 61 increases. Accordingly, for a given communication signal frequency, the signal db gain across tool joint 70 generally increases as the axial compressive load on the tool joint increases. For instance, for an AC communication signal having a frequency of 2,000 Hz, with no axial gap between shoulders 53, 61 (i.e., very high axial compressive load on the tool joint 70), the measured gain across the inductive communication coupler is about −0.2 dB; with an axial gap of 10 mil between shoulders 53, 61 (i.e., a moderate to high axial compressive load on the tool joint 70), the measured gain across the inductive communication coupler is about −0.8 dB; with an axial gap of 32 mil between shoulders 53, 61 (i.e., a moderate compressive load on the tool joint 70), the measured gain across the inductive communication coupler is about −1.8 dB; and with an axial gap of 61 mil between shoulders 53, 61 (i.e., a moderate to low axial compressive load on the tool joint 70), the measured gain across the inductive communication coupler is about −2.8 dB.

As previously described with respect to FIG. 8, the measured signal level across exemplary inductive coupler elements 110, 120 of FIGS. 6 and 7 generally increases as the axial compressive load increases. Similarly, the measured signal level across exemplary inductive coupler elements 110, 120 of FIG. 5 generally increases as the axial compressive load increases. Thus, both embodiments of inductive coupler elements 110, 120 shown in FIGS. 6 and 7 exhibit similar behavior when subjected to varying axial compressive loads.

Figure 10:
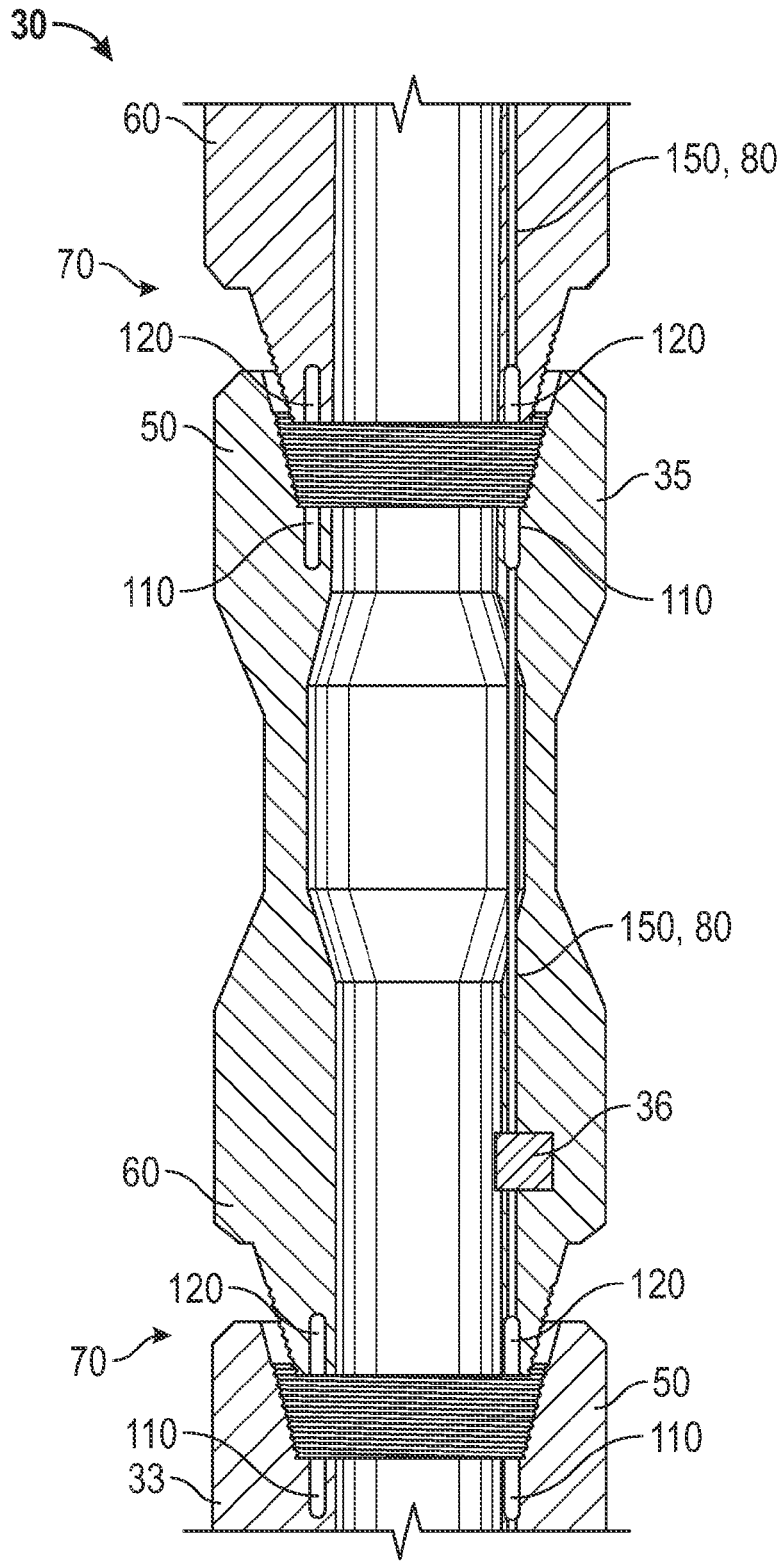
FIG. 10 is an enlarged cross-sectional view of the load analysis sub of FIG. 1.

Referring now to FIG. 10, axial load analysis sub 35 is disposed in drillstring 30 axially adjacent and above BHA 33. In this embodiment, load analysis sub 35 includes a communication link 80 as previously described and a signal level determination unit 36 electrically coupled to link 80. In this embodiment, unit 36 measures, or otherwise determines, the level of the communication signal in cable 150 and communicates the signal level to surface system 40 through the remainder of the communication link in drillstring 30. In general, unit 36 may determine any signal characteristic representative of the signal level generated by coupler element 120 of sub 35 including, without limitation, the signal amplitude (e.g., voltage amplitude, current amplitude, power amplitude, etc.), the signal gain (e.g., voltage gain, power gain, etc.) across inductive communication coupler 100 between sub 35 and BHA 33, or the signal communication efficiency across inductive communication coupler 100 between sub 35 and BHA 33.

Figure 11:
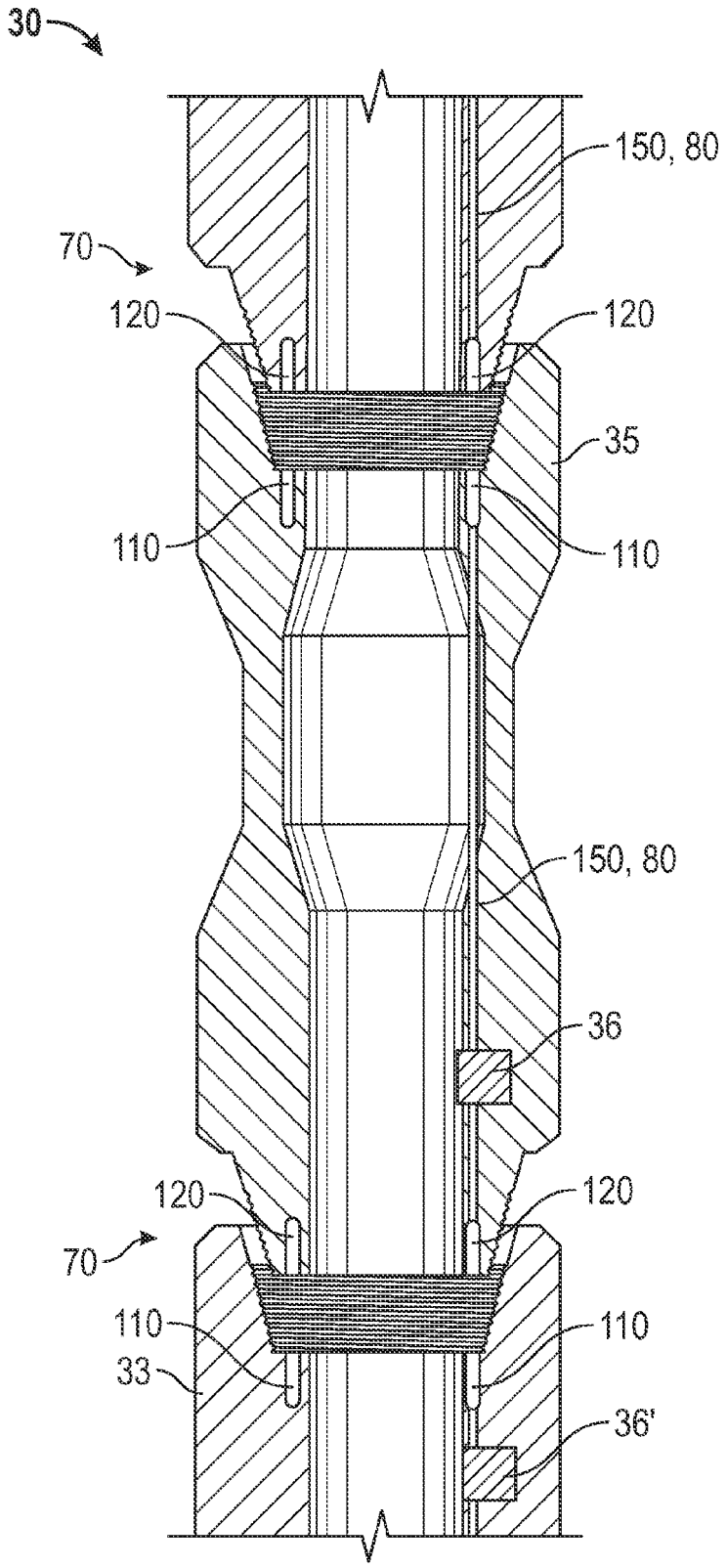
FIG. 11 is an enlarged cross-sectional view of an embodiment of a load analysis sub.

Determination of signal gain and efficiency across inductive communication coupler 100 requires comparison of the power or amplitude of the communication signal on both sides of inductive communication coupler 100 (i.e., at coupler element 110 and at coupler element 120). Thus, in such cases the power or amplitude of the signals on both sides of communication coupler 100 are determined and compared. For instance, in FIG. 11, the upstream signal level in coupler element 120 of sub 35 is determined by unit 36, and the upstream signal level in coupler element 110 of BHA 33 is determined by another signal level determination unit 36' in BHA 33 and communicated to unit 36 in sub 35 for comparison to the downstream signal level in sub 35.

In general, the signal level determinations by unit 36 may be made on a periodic (e.g., one signal level measurement per second) or continuous basis, and further, the measured signal levels may be communicated to the surface real time (i.e., as measured) or on a periodic basis (e.g., batch manner). The frequency of measurement of the signal level may be different than the frequency of communication of the signal level to the surface. In general, the frequency of measurement of the signal level is preferably sufficiently high to enable an acceptable degree of axial load sensitivity. The frequency of communication of the signal level to the surface may be influenced by other factors such as data rate, bandwidth, reach, etc.

To enable the communication signal level determinations and communication of such signal level determinations, unit 36 includes a signal level sensor, processor(s), data storage, and a signal communicator or modem. Unit 36 may receive power from BHA 33, the surface, or have its own power supply (e.g., batteries). The processor(s) may include, for example, one or more general-purpose microprocessors, digital signal processors, microcontrollers, or other suitable instruction execution devices known in the art. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems. The storage is a non-transitory computer-readable storage device and includes volatile storage such as random access memory, non-volatile storage (e.g., a hard drive, an optical storage device (e.g., CD or DVD), FLASH storage, read-only-memory), or combinations thereof.

As previously described, in this embodiment, the signal level determined by unit 36 is communicated to system 40 at the surface. System 40 uses the signal level communicated by unit 36 to determine the axial load at sub 35 during downhole drilling operations. Accordingly, system 40 may also be described as comprising an axial load determination unit or system. Since sub 35 is axially adjacent BHA 33 and bit 32, the axial load in drillstring 30 at sub 35 is the same or substantially the same as the axial load on bit 32 (i.e., the WOB).

To determine the axial load in drillstring 30 at sub 35, system 10 and unit 36 are calibrated to map the signal levels determined by unit 36 across a range of axial loads under known conditions. More specifically, early in the drilling process when borehole 11 is vertical (i.e., before any directional or horizontal drilling), known axial loads are applied to drillstring 30 and the measured and/or determined signal levels from unit 36 for the known applied axial loads are mapped, resulting in a table or plot of signal level versus axial load. For example, bit 32 may be lifted off the borehole bottom to determine the signal level at zero axial load; bit 32 may be placed on the borehole bottom and 100 k lbs applied to drillstring 30 (e.g., with collars at the surface) to determine the signal level at 100 k lbs of axial load; bit 32 may be placed on the borehole bottom and 200 k lbs applied to drillstring to determine the signal level at 200 k lbs of axial load; and so on. Then, during subsequent drilling operations (vertical, directional, horizontal, etc.), the measured and/or determined signal levels communicated by unit 36 are compared to the table or plot to determine the axial load at sub 35, and hence, the WOB. As is shown in FIGS. 8 and 9, and will be discussed in more detail below, the frequency of the communication signal influences the signal level (e.g., power gain) at a given axial load. Consequently, the frequency of the communication signal during drilling operations is preferably the same as the frequency of the communication signal during the calibration process. Of course, system 10 and unit 36 may calibrated across multiple frequencies, and any one or more of those calibrated frequencies may be used during drilling operations. Alternatively, unit 36 can be calibrated after fabrication in a controlled environment (e.g., lab) by applying a known series of axial loads to map the signal levels determined by unit 36 across the range of axial loads under known conditions (e.g., temperature, pressure, bending, etc.).

During drilling operations, it should be appreciated that determination of axial loads at or near the bit (e.g., at sub 35) is a more accurate indicator of WOB than the determination of axial loads at the surface or along the drillstring distal the bit as loads other than the known applied axial loads can act on the drillstring, potentially resulting in differences between the known axial loads applied to the drillstring and the actual WOB. Accordingly, determining the actual axial loads at sub 35 proximal bit 32 offers the potential for improved WOB determinations as compared to other means of determining axial loads at locations distal the bit.

In this embodiment, the communication signal level is measured and/or determined at unit 36 and then communicated to system 40 at the surface, which then determines the axial load at sub 35 and WOB based on the signal level. However, in other embodiments, determination of the axial load at sub 35 and WOB based on the communication signal level may be performed with unit 36, and then communicated to system 40 at the surface. In such embodiments, the signal level determination unit (e.g., unit 36) also functions as an axial load determination unit. For example, the mapping of axial load versus signal level may be communicated and stored in unit 36, and then accessed by unit 36 to determine the axial load in sub 35 and WOB upon measurement and/or determination of signal level by unit 36. In addition, although signal level determination unit 36 is shown and described as being housed within axial load analysis sub 35 in this embodiment, in general, the signal level determination unit (e.g., unit 36) may be housed or part of other components in the drillstring (e.g., drillstring 30) including, without limitation, a repeater, BHA, or WDP. In other words, the signal level determination unit may be housed in a stand alone sub (e.g., sub 35) or incorporated into an existing tool such as a repeater, MWD or LWD telemetry tool in the BHA, etc. Still further, although only one signal level determination unit 36 is shown and described in the embodiment shown in FIG. 10, in other embodiments, more than one signal level determination unit (e.g., unit 36) may be disposed along the drillstring (e.g., drillstring 30), thereby offering the potential to determine the distribution of axial loads at various points along the drillstring. The distribution of axial loads along the drillstring can be used to identify trouble spots such as stuck points or regions of high interaction between the drillstring and borehole sidewall.

Figure 12:
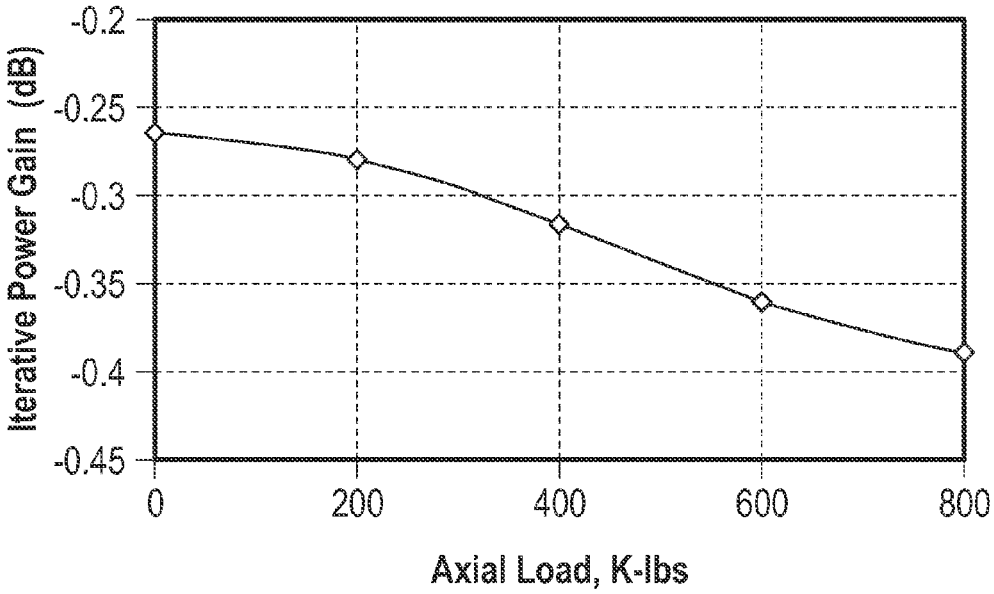
FIG. 12 is a graphical illustration of the gain of a 50 kHz signal across the inductive communication coupler of FIG. 6 over a range of axial loads.
Figure 13:
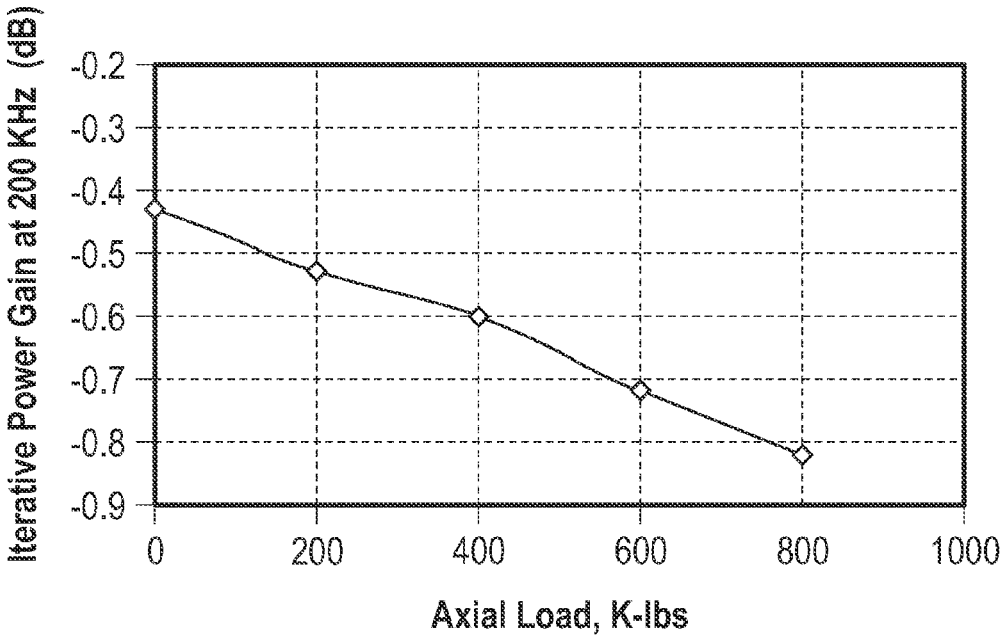
FIG. 13 is a graphical illustration of the gain of a 200 kHz signal across the inductive communication coupler of FIG. 6 over a range of axial loads.

Referring now to FIGS. 12 and 13, the frequency of the communication signal influences the sensitivity of the axial load determinations. In particular, the sensitivity of the axial load determinations is directly related to the frequency of the communication signal—the greater the frequency, the more sensitive the axial load determinations. For example, in FIG. 12, the measured power gain across exemplary inductive coupler elements 110, 120 of FIGS. 6 and 7 for a 50 kHz communication signal is shown at different axial compressive loads on tool joint 70, and in FIG. 13, the measured power gain across exemplary inductive coupler elements 110, 120 of FIGS. 6 and 7 for a 200 kHz communication signal is shown at different axial compressive loads on tool joint 70. The variation in the power gain for a given change in axial load is greater for the 200 kHz communication signal than the 50 kHz communication signal. Thus, the communication signal frequency for axial load sensing can be optimized to enhance the sensitivity of the axial load determinations.

Figure 14:
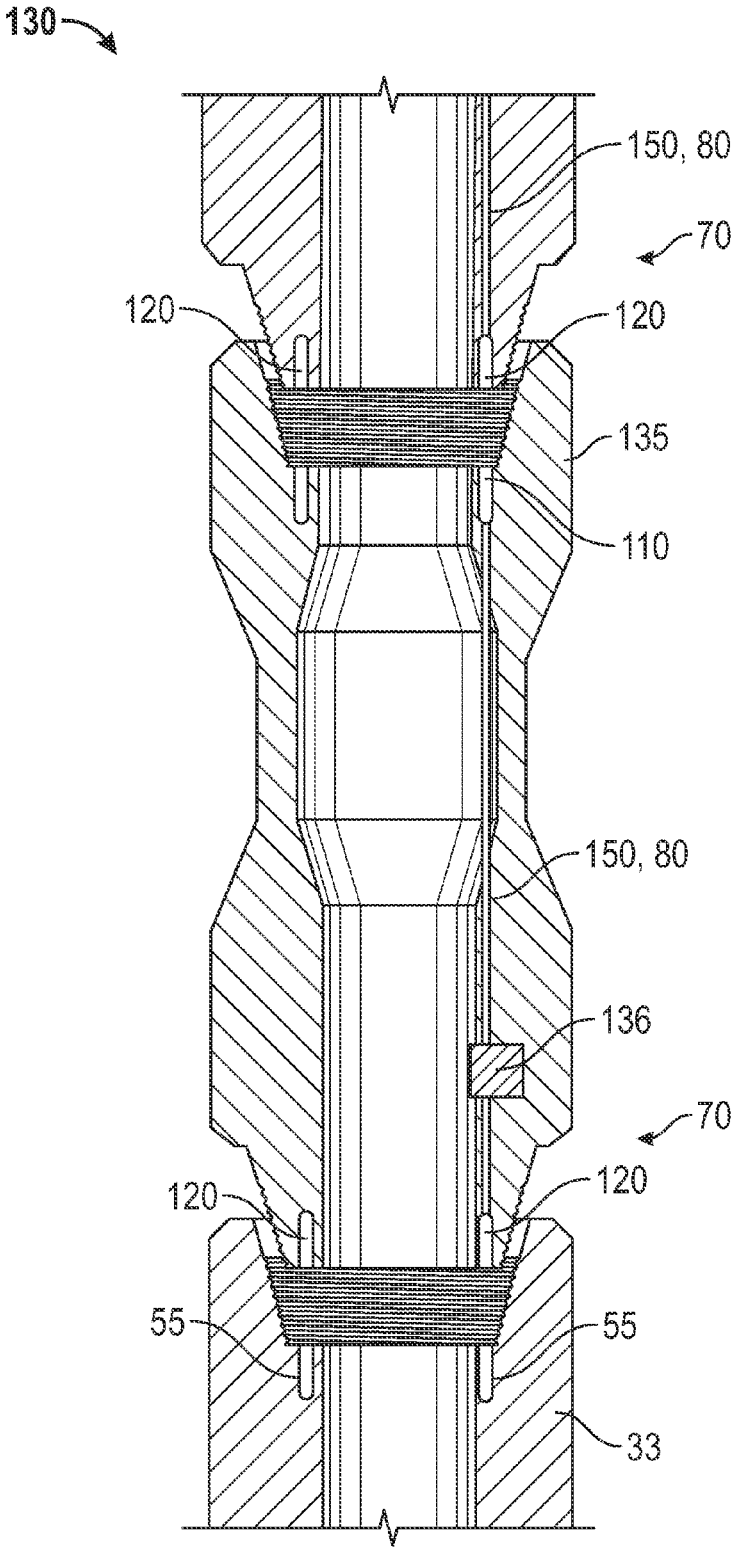
FIG. 14 is an enlarged cross-sectional view of an embodiment of a load analysis sub.

Referring now to FIG. 14, an embodiment of an axial load analysis sub 135 disposed in a drillstring 130 axially adjacent a BHA 33 as previously described is shown. In this embodiment, load analysis sub 135 includes a communication link 80 as previously described and an impedance measurement unit 136 electrically coupled to link 80. However, no inductive coupler element 110, 120 is provided in recess 55 axially opposite lower inductive coupler element 120 in sub 135.

Figure 15:
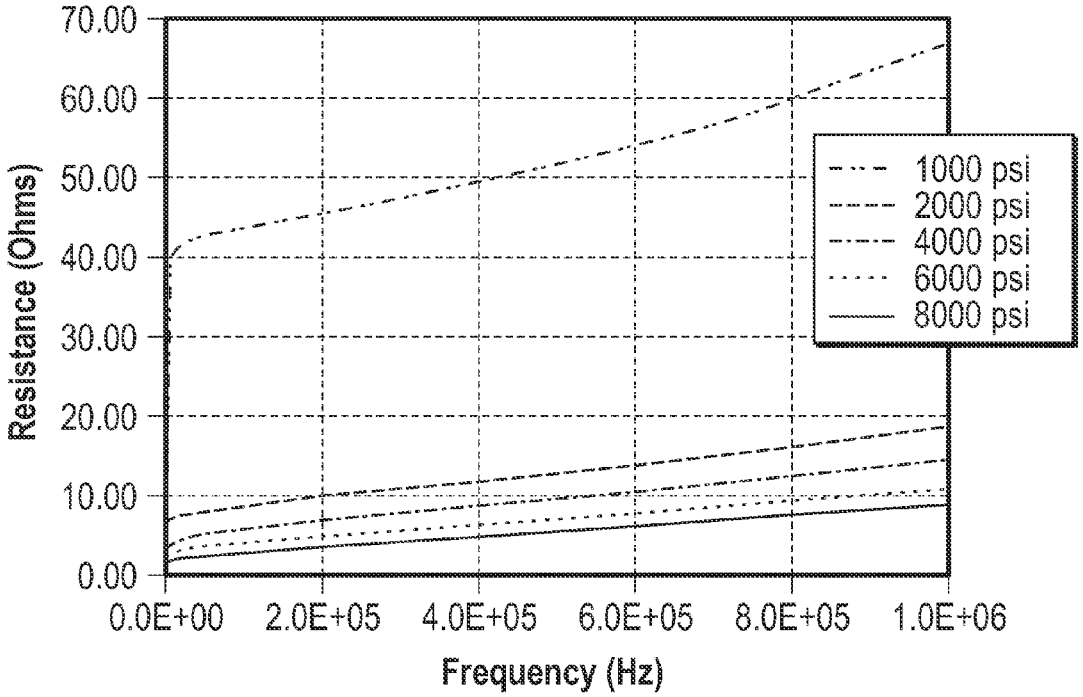
FIG. 15 is a graphic illustration of the measured resistance across the coupler element of FIG. 14 as a function of axial compressive stress over a range of signal frequencies.

Methods for determining axial loads and WOB by measuring signal characteristics in WDP can also be employed in embodiments including only one inductive coupler element 110, 120 at a tool joint 70 as is shown in FIG. 14. In particular, for a given signal frequency, the impedance across the single inductive coupler element 110, 120 varies as a function of axial loading of the corresponding tool joint 70. Referring briefly to FIG. 15, the measured resistance (or impedance) across exemplary coupler element 120 (i.e., the impedance across wires 151, 152) of FIG. 14 is shown at different axial compressive stress on tool joint 70 over a range of signal frequencies. For a given communication signal frequency, the resistance (or impedance) across tool joint 70 generally increases as the axial compressive stress (i.e., axial compressive load) on tool joint 70 decreases. For instance, for an AC communication signal having a frequency of 20,000 Hz, with a 8,000 psi axial compressive stress on the tool joint 70, the measured resistance across a single inductive coupler element 110, 120 is about 4.0 ohms; with a 6,000 psi axial compressive stress on the tool joint 70, the measured resistance across a single inductive coupler element 110, 120 is about 5.0 ohms; with a 4,000 psi axial compressive stress on the tool joint 70, the measured resistance across a single inductive coupler element 110, 120 is about 7.0 ohms; with a 2,000 psi axial compressive stress on the tool joint 70, the measured resistance across a single inductive coupler element 110, 120 is about 10.0 ohms; and with a 1,000 psi axial compressive stress on the tool joint 70, the measured resistance across a single inductive coupler element 110, 120 is about 45.0 ohms. This phenomena can be leveraged to measure axial loads and WOB using an inductive coupler element 110, 120 as shown in FIG. 5 or an inductive coupler element 110, 120 as shown in FIGS. 6 and 7.

Referring again to FIG. 14, in this embodiment, unit 136 measures, or otherwise determines, the impedance across coupler element 120 (i.e., the impedance across wires 151, 152) and communicates the measured impedance to surface system 40. In particular, a signal is communicated from system 40 to sub 135 via communication links 80 in each tubular in drillstring 130 and inductive communication couplers 100 in each tool joint 70 in drillstring 30. Unit 136 measures the impedance across coupler element 120 and communicates the measured impedance to surface system 40. The measured impedance may be communicated to system 40 back through the same communication links 80 and inductive communication couplers 100 relied on to transmit the signal from system 40 to sub 35, or the measured impedance may be communicated from unit 136 through a separate communication mechanism such as a different WDP communication link in drillstring or telemetry system.

In general, the impedance measurements by unit 136 may be made on a periodic (e.g., one impedance measurement per second) or continuous basis, and further, the measured impedance may be communicated to the surface real time (i.e., as measured) or on a periodic basis (e.g., batch manner). The frequency of measurement of the signal level may be different than the frequency of communication of the signal level to the surface. In general, the frequency of measurement of the signal level is preferably sufficiently high to enable an acceptable degree of axial load sensitivity. The frequency of communication of the signal level to the surface may be influenced by other factors such as data rate, bandwidth, reach, etc.

To enable the impedance measurements and communication of such impedance measurements, unit 136 includes an impedance sensor or detector, processor(s), data storage, and a signal communicator or modem. Unit 136 may receive power from BHA 33, the surface, or have its own power supply (e.g., batteries). The processor(s) may include, for example, one or more general-purpose microprocessors, digital signal processors, microcontrollers, or other suitable instruction execution devices known in the art. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems. The storage is a non-transitory computer-readable storage device and includes volatile storage such as random access memory, non-volatile storage (e.g., a hard drive, an optical storage device (e.g., CD or DVD), FLASH storage, read-only-memory), or combinations thereof.

As previously described, in this embodiment, the impedance across coupler element 120 measured by unit 136 is communicated to a system 40 as previously described at the surface. System 40 uses the impedance measurement communicated by unit 136 to determine the axial load at sub 135 during downhole drilling operations. Accordingly, system 40 may also be described as comprising an axial load determination unit. Since sub 135 is axially adjacent BHA 33 and the bit coupled to BHA 33 (e.g., bit 32), the axial load in drillstring 130 at sub 135 is the same or substantially the same as the axial load on the bit (i.e., the WOB).

To determine the axial load in drillstring 130 at sub 135, the drilling system and unit 136 are calibrated as previously described to map the impedance measured by unit 136 across a range of axial loads under known conditions. Then, during subsequent drilling operations (vertical, directional, horizontal, etc.), the measured impedance communicated by unit 136 are compared to the table or plot to determine the axial load at sub 135, and hence, the WOB. The frequency of the signal analyzed by unit 136 influences the measured impedance at a given axial load. Consequently, the frequency of the signal during drilling operations is preferably the same as the frequency of the communication signal during the calibration process. Of course, unit 136 may be calibrated across multiple frequencies, and any one or more of those calibrated frequencies may be used during drilling operations.

In this embodiment, the impedance is measured at unit 136 and then communicated to system 40 at the surface, which then determines the axial load at sub 135 and WOB based on the measured impedance. However, in other embodiments, the determination of the axial load at sub 135 and WOB based on the measured impedance may be performed with unit 136, and then communicated to system 40 at the surface. In such embodiments, the impedance measurement unit (e.g., unit 136) also functions as an axial load determination unit. For example, the mapping of axial load versus impedance may be communicated and stored in unit 136, and then accessed by unit 136 to determine the axial load in sub 135 and WOB upon measurement impedance by unit 36. In addition, although impedance measurement unit 136 is shown and described as being housed within axial load analysis sub 135 in this embodiment, in general, the impedance measurement unit (e.g., unit 136) may be housed or part of other components in the drillstring (e.g., drillstring 130) including, without limitation, a repeater, BHA, or WDP. Still further, although only one impedance measurement unit 36' is shown and described in the embodiment shown in FIG. 14, in other embodiments, more than impedance measurement unit (e.g., unit 136) may be disposed along the drillstring (e.g., drillstring 130), thereby offering the potential to determine the distribution of axial loads at various points along the drillstring. As previously described, the distribution of axial loads along the drillstring can be used to identify trouble spots such as stuck points or regions of high interaction between the drillstring and borehole sidewall.

In the embodiment shown in FIG. 14, a signal is communicated downhole from the surface to sub 135 and unit 136 measures the impedance across inductive coupler element 120. However, in other embodiments, a signal can be communicated from BHA 33 to an inductive coupler element 110 that is not opposed by a corresponding coupler element 120, and impedance measured across that inductive coupler element 110 and communicated to system 40. In still other embodiments, a signal may be generated by unit 136 and passed through coupler element 120 to measure the impedance across coupler element 120.

In the manners described, embodiments of systems and methods described herein may be used to determine axial loads at one or more point along a drillstring and WOB. Such embodiments offer the potential for improved accuracy in axial load and WOB determinations as compared to conventional techniques that rely on strain gauges. For example, embodiments described herein measure the level of a communication signal that is transmitted across annular coupler elements 110, 120 or impedance across an inductive coupler element 110, 120. Coupler elements 110, 120 extending circumferentially around opposed shoulders 53, 61, respectively, and thus, are effectively measuring an average signal level or impedance, and hence, determining an average axial load. Consequently, embodiments described herein are less susceptible to inaccuracies that may result in conventional strain gauges from bending of the drillstring and temperature gradients across the drillstring (e.g., unequal temperatures between the ID and OD). In addition, by flowing drilling mud through drillstring 30, 130 during the calibration process (in the field or in the lab), embodiments described herein offer the potential to reduce and/or eliminate the impacts of pressure differentials acting on drillstring during subsequent drilling operations. Further, signal level determinations and impedance measurements have minimal temperature sensitivity, and thus, do not require temperature compensation as are required by conventional strain gauges.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drilling system for drilling a borehole in an earthen formation, comprising:

a drillstring having a longitudinal axis, a first end, and a second end opposite the first end;

wherein the drillstring includes a dill bit at the second end, a bottomhole assembly coupled to the drill bit, and a plurality of interconnected tubular members coupled to the bottomhole assembly;

wherein each tubular member has a first end and a second end opposite the first end;

wherein a first tubular member of the plurality of tubular members includes a communication link having a first annular inductive coupler element disposed in an annular recess in the first end of the first tubular member, a second annular inductive coupler element disposed in an annular recess in the second end of the first tubular member, and a cable coupling the first annular inductive coupler element to the second annular inductive coupler element;

wherein the second end of the first tubular member is threadably coupled to an axially adjacent tubular member at a threaded tool joint;

a first signal level determination unit disposed in the drillstring, wherein the signal level determination unit is configured to determine a level of a first signal communicated from the second inductive coupler element; and an axial load determination unit configured to determine an axial load at the threaded tool joint based on the level of the first signal determined by the first signal level determination unit.

2. The drilling system of claim 1, wherein the first signal level determination unit is disposed in a sub axially adjacent the bottomhole assembly.

3. The drilling system of claim 1, wherein the first signal level determination unit is configured to communicate the level through the drillstring to the axial load determination unit at the surface.

4. The drilling system of claim 1, wherein the first signal level determination unit is the axial load determination unit.

5. The drilling system of claim 1, wherein the level is a signal amplitude.

6. The drilling system of claim 1, further comprising a second signal level determination unit disposed in the drillstring;

wherein the second signal level determination unit is configured to determine a level of the second signal communicated to the second inductive coupler element and communicate the level of the second signal to the first signal level determination unit;

wherein the first signal level determination unit is configured to determine a gain based on the level of the first signal and the level of the second signal.

7. The drilling system of claim 6, wherein the first signal level determination unit is configured to communicate the gain to the axial load determination unit at the surface; and wherein the axial load determination unit is configured to determine the axial load in the drillstring at the first signal level determination unit based on the gain.

8. The drilling system of claim 6, wherein the first signal level determination unit is the axial load determination unit and is configured to determine the axial load in the drillstring at the first signal level determination unit based on the gain.

9. The drilling system of claim 1, wherein each inductive coupler elements comprises:

an annular magnetically conducting electrically insulating (MCEI) element; and an electrically conductive coil disposed within an annular trough in the MCEI element.

10. The drilling system of claim 1, wherein each inductive coupler elements comprises:

an annular high-conductivity, low permeability (HCLP) element; and an annular inductive toroid disposed within an annular trough in the HCLP element.

11. The drilling system of claim 1, wherein the annular recess in the first end of the first tubular member is disposed in a radially inner shoulder of a box end of the first tubular member; and wherein the annular recess in the second end of the first tubular member is disposed in a radially inner shoulder of a pin end of the first tubular member.

12. The drilling system of claim 1, wherein a second tubular member includes a communication link having a first annular inductive coupler element disposed in an annular recess in the first end of the second tubular member, and a second annular inductive coupler element disposed in an annular recess in the second end of the second tubular member, and a cable coupling the first annular inductive coupler element of the second tubular member to the second annular inductive coupler element of the second tubular member;

a second signal level determination unit disposed in the drillstring, wherein the second signal level determination unit is configured to determine a level of a second signal communicated from the second inductive coupler element of the communication link in the second tubular member; and an axial load determination unit configured to determine an axial load at the second signal level determination unit based on the level of the second signal determined by the second signal level determination unit.

13. A method for determining axial loads in a drillstring, the method comprising:

(a) drilling with a drilling system including a drillstring comprising a drill bit, a bottomhole assembly coupled to the drill bit, and a plurality of WDP joints coupled to the bottomhole assembly;

(b) measuring a level of a first signal communicated from a first inductive coupler element in the drillstring during (a);

(c) measuring a level of a second signal communicated to the first inductive coupler element during (a);

(d) communicating the level of the second signal;

(e) calculating a gain with the level of the first signal and the level of the second signal; and (f) determining an axial load in a first region of the drillstring using the gain.

14. The method of claim 13, further comprising communicating the level of the first signal and the level of the second signal through the plurality of WDP joints in the drillstring to the surface;

wherein step (e) and step (f) are performed at the surface.

15. The method of claim 13, wherein the step (e) and the step (f) are performed in the drillstring; and wherein the axial load is communicated through the plurality of WDP joints in the drillstring to the surface.

16. The method of claim 13, wherein the step (b) comprises measuring an amplitude of the first signal communicated from the first inductive coupler element.

17. The method of claim 13, wherein the level of the first signal and the level of the second are determined proximal a drill bit in the drillstring.

18. The method of claim 13, wherein the first inductive communication coupler comprises:

an annular magnetically conducting electrically insulating (MCEI) element; and an electrically conductive coil disposed within an annular trough in the MCEI element.

19. The method of claim 13, wherein the first inductive communication coupler comprises:

an annular high-conductivity, low permeability (HCLP) element; and an annular inductive toroid disposed within an annular trough in the HCLP element.

20. The method of claim 13, further comprising:

calibrating the drilling system in a vertical borehole by applying a plurality of known axial loads onto the drillstring and measuring the level of the first signal communicated from a first inductive coupler element in the drillstring and the level of the second signal communicated to the first inductive coupler element in the drillstring at each of the known axial loads.

21. A drilling system for drilling a borehole in an earthen formation, comprising:

a drillstring having a longitudinal axis, a first end, and a second end opposite the first end;

wherein the drillstring includes a dill bit at the second end, a bottomhole assembly coupled to the drill bit, and a plurality of interconnected tubular members coupled to the bottomhole assembly;

wherein each tubular member has a first end and a second end opposite the first end;

wherein a first tubular member includes a communication link having a first annular inductive coupler element disposed in an annular recess in the first end of the first tubular member, and a second annular inductive coupler element disposed in an annular recess in the second end of the first tubular member and electrically coupled to the first inductive coupler element;

a first impedance measurement unit disposed in the drillstring, wherein the first impedance measurement unit is configured to determine an impedance of the second inductive coupler element.

22. The drilling system of claim 21, wherein the first impedance measurement unit is disposed in a sub axially adjacent the bottomhole assembly.

23. The drilling system of claim 21, wherein the first impedance measurement unit is configured to communicate the impedance through the drillstring to the surface.

24. The drilling system of claim 23, further comprising an axial load determination unit configured to determine the axial load in the drillstring proximal the first impedance measurement unit based on the impedance.

25. The drilling system of claim 21, wherein the first impedance measurement unit is the axial load determination unit.

26. The drilling system of claim 21, wherein the second inductive coupler element comprises:

an annular magnetically conducting electrically insulating (MCEI) element; and an electrically conductive coil disposed within an annular trough in the MCEI element.

27. The drilling system of claim 21, wherein the second inductive coupler element comprises:

an annular high-conductivity, low permeability (HCLP) element; and an annular inductive toroid disposed within an annular trough in the HCLP element.

28. The drilling system of claim 21, wherein a second tubular member includes a communication link having a first annular inductive coupler element disposed in an annular recess in the first end of the second tubular member, and a second annular inductive coupler element disposed in an annular recess in the second end of the second tubular member and electrically coupled to the first inductive coupler element of the second tubular member;

a second impedance measurement unit disposed in the drillstring, wherein the second impedance measurement unit is configured to determine an impedance of the second inductive coupler element of the second tubular member.

* * * * *